United States Patent [19]

Cummings et al.

[11] Patent Number: 4,994,635

[45] Date of Patent: Feb. 19, 1991

[54] PUSH BUTTON AUTOMOTIVE VACUUM-ELECTRIC AIR CONTROL DEVICES HAVING IMPROVED VALVING, SWITCHING AND DELATCHING

[75] Inventors: John G. Cummings, Cary; Martin R. Cobb, Northbrook, both of Ill.

[73] Assignee: Indak Manufacturing Corp., Northbrook, Ill.

[21] Appl. No.: 326,026

[22] Filed: Mar. 20, 1989

[51] Int. Cl.[5] ..... H01H 9/06

[52] U.S. Cl. ..... 200/61.86; 137/596; 137/637; 200/5 E

[58] Field of Search ..... 200/16 C, 16 D, 5 E, 200/5 EA, 5 EB, 61.86, 50 C, 318, 328; 137/353, 596, 637, 625.2, 625.42

[56] References Cited

U.S. PATENT DOCUMENTS

| | | | |
|---|---|---|---|
| 3,637,962 | 1/1972 | Fiddler et al. | 200/61.86 |
| 4,383,147 | 5/1983 | Raab et al. | 200/50 C |
| 4,448,390 | 5/1984 | Halstead et al. | 251/176 |
| 4,517,422 | 5/1985 | Black, III et al. | 200/50 C |
| 4,716,264 | 12/1987 | Toulouse | 200/61.86 |
| 4,720,612 | 1/1988 | Cummings | 200/61.86 |

*Primary Examiner*—J. R. Scott

*Attorney, Agent, or Firm*—Burmeister, York, Palmatier & Zummer

[57] ABSTRACT

Several individually operable push buttons are provided to initiate an OFF function, defrost, air conditioning and various air directions and other functions of an automotive heating, ventilating and air conditioning system. Each push button has a carriage adapted to be fitted on one side with an optional leaf spring contactor engageable with fixed contact members. The opposite side of the carriage is fixedly fitted with a compressible silicone rubber or other resilient valve member in sealing engagement with a port plate to carry out vacuum valving functions. Each carriage is guided by a tongue-and-slot guiding arrangement, whereby sealing pressure is applied between the valve member and the port plate. Each carriage has a rearwardly projecting tongue, slidably received in a slot formed in flange structure on the port plate. The front portion of each push button is also slidably guided to maintain the sealing pressure. Each push button has its own coiled return spring, received and detained in a semicylindrical nest, offset laterally on the carriage and overlapping the valve member and the contactor, thus affording a highly compact construction. A delatching mechanism is provided, whereby depression of a single push button, or any of a plurality of push buttons, delatches all of the other push buttons, including one push button having a push-push latching action. The delatching mechanism is operative to displace and disable a latching hook which produces the push-push latching action, while also displacing latching bars for the other push buttons.

15 Claims, 19 Drawing Sheets

FIG. 49
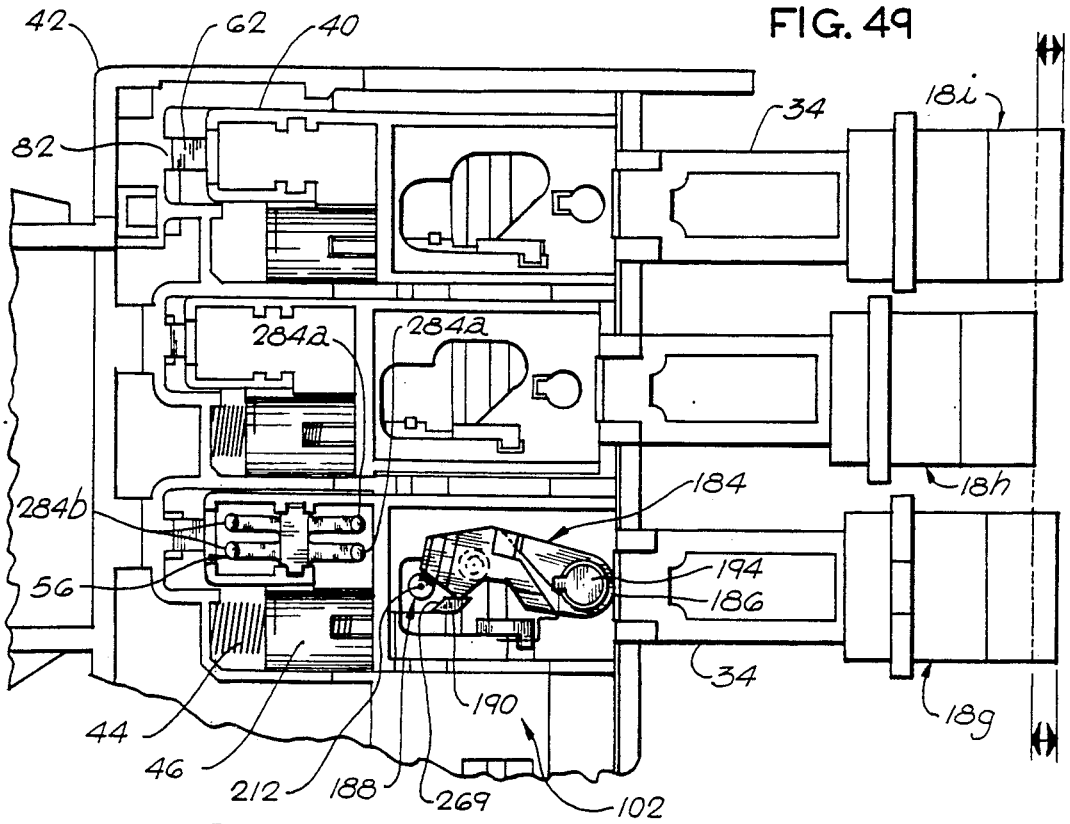
FIG. 52
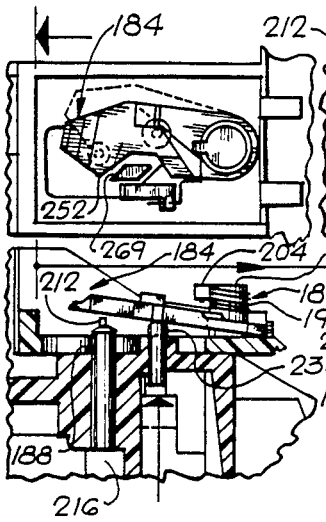
FIG. 53
FIG. 51
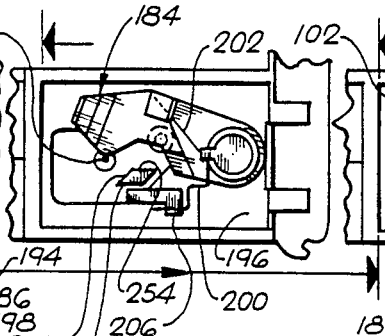
FIG. 50
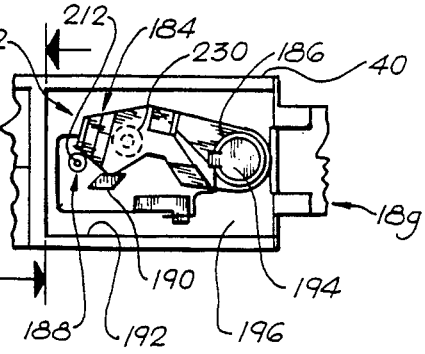
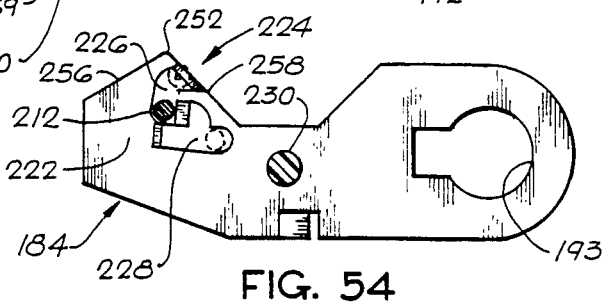
FIG. 54

70
318
316

316
314
312
70
316
314
316
314

60
79
290

79
302
300
60
298

60
290

56
284b
284a 56
284b
284a 56
284b 79
300
60
290

79
296
302
300
60
294
292
290

132

132

132

22
23

23

22
23

PUSH BUTTON AUTOMOTIVE VACUUM-ELECTRIC AIR CONTROL DEVICES HAVING IMPROVED VALVING, SWITCHING AND DELATCHING

FIELD OF THE INVENTION

This invention relates to control devices or units for controlling the various functions of automotive heating, ventilating and air conditioning systems, also referred to herein as automotive air control systems. Such control units select various modes of operation, which may include heating, ventilation, maximum air conditioning, normal air conditioning, windshield defogging or defrosting, use of floor, panel and windshield air outlets, recirculation of inside air, intake of outside air, and OFF, for example. Various combinations of modes may be selected for simultaneous use. In some cases, some of the functions or modes may be omitted, particularly the air conditioning functions.

BACKGROUND OF THE INVENTION

A variety of vacuum-electric control units or devices have been employed for controlling automotive heating, ventilating and air conditioning systems. Control units of one type have employed a single movable function control member, such as a lever or slider, having a multiplicity of positions, corresponding with the desired functional modes of operation. The multiposition lever or slider may operate one or more multiposition vacuum control valves and one or more electrical switches. The switches may control the energization of a blower motor and an air conditioning clutch, whereby an air conditioning compressor is driven by the engine of the vehicle. The multiposition vacuum control valve may supply intake manifold vacuum to various vacuum motors for operating doors or valve plates in the air duct system, for controlling the movement of air to and from the desired locations in the system.

In addition to the function control member, there is often a heat control member, which may be in the form of a movable lever or slider, for regulating the amount of heat supplied by the system, and a multiposition blower speed control switch, for regulating the speed of the blower motor.

There are also control units of the push button type, having a series of push buttons for selecting the various operating functions or modes. In a prior construction of one type, the push buttons operate a complex mechanical selector mechanism, whereby each push button actuates selected control elements, which may include a selected vacuum control valve or a selected electrical switch, or both. The selector mechanism may utilize cam action selectors or linkage plate selectors. Such push button control units tend to be rather complex in construction.

Another type of prior construction has employed a plurality of push buttons, each of which operates a separate vacuum valve to accomplish a particular control function. Thus, for example, there may be four push buttons and four vacuum valves, each of which may be operated by one of the push buttons. The push buttons may latch down individually. In some cases, more than one push button may be operated simultaneously.

There has also been another type of prior construction which has employed a plurality of push buttons, each of which operates a separate electrical switch to accomplish a particular electrical control function. The push buttons may latch down individually.

There has also been a prior construction having push buttons, each of which operates its own electrical switch, to accomplish a particular electrical control function, and its own vacuum valve, to perform one or more vacuum switching functions.

SUMMARY OF THE INVENTION

One object of the present invention is to provide a new and improved push button vacuum-electric control device in which each of several or all of the push buttons have improved vacuum valving means associated therewith and operable by movement of the push button.

A further object is to provide a new and improved vacuum-electric control device of the foregoing character, having soft resilient valve members, mounted on and operable by the individual push buttons, together with improved means for maintaining adequate sealing pressure between the vacuum valve and a port plate, along which the vacuum valves are slidable.

Another object is to provide a new and improved push button vacuum-electric control device, in which each push button has improved means for mounting and retaining a return spring.

It is another object of the present invention to provide a new and improved push button vacuum-electric control device having an improved delatching mechanism whereby a plurality of separately latchable push buttons are delatched by operation of a single push button, or any of a plurality of push buttons.

A further object is to provide a new and improved push button vacuum-electric control device of the foregoing character, having an improved delatching mechanism for delatching a plurality of sets of latchable push buttons while also delatching an air conditioning control push button having a push-push latching action.

In one aspect, the present invention provides a vacuum-electric control device, comprising an array of push buttons mounted or formed on longitudinally movable push button members or shafts, each of which has a portion serving as a carriage for supporting a vacuum valve member, on one side thereof, and, in at least some cases, electrical contactor means, on the opposite side. The vacuum valve member is preferably made of silicone rubber, or some other similar soft resilient material, and is slidable along a port plate having valve ports therein. The contactor means, when provided, incorporates spring means affording a biasing force and contact pressure between the contactor means and stationary electrical contact means. Each push button carriage is guided by a tongue-and-slot guiding arrangement, constructed and arranged so that adequate sealing pressure is maintained between the corresponding soft resilient valve member and the port plate. The tongue-and-slot guiding arrangement is interposed between each carriage and adjacent stationary supporting structure formed on the port plate or secured thereto. Preferably, each carriage has a tongue projecting rearwardly therefrom and slidably received in a slot formed in the supporting structure, which may take the form of flange means projecting upwardly from the rear portion of the port plate. There is a precision sliding fit between the tongue and the upper wall of the slot, whereby the carriage is gently pressed toward the port plate, to provide the desired sealing pressure between the soft resilient valve member and the cooperating surface of the port plate, so that the valve member will be maintained in sealing engagement with the port plate and will seal around the associated valve ports therein.

Preferably, each push button carriage is also slidably guided in a generally rectangular nest or recess formed by a flange structure projecting from the port plate.

The front end of each push button shaft is also preferably slidably guided by the cooperative slidable engagement of guide means or elements on the push button shaft and the stationary supporting structure, formed on portions of the housing for the control device.

In accordance with another aspect of the present invention, each of the push button shafts is provided with its own return spring which is offset laterally from the center line of the corresponding push button carriage. The offset arrangement makes a compact construction in which the guiding tongue on the carriage can be formed in an oppositely offset position on the carriage. A generally semicylindrical nest is preferably provided in each push button carriage for receiving the corresponding return spring. There are preferably elements on the nest structure which lightly detain the return spring in the nest, to make assembly of the control device easier. The offset arrangement of the return spring makes it possible to provide a compact construction, in which the depth of the control device is minimized.

In accordance with another aspect of the present invention, the control device comprises a delatching mechanism whereby the depression of a single push button, or any of a plurality of push buttons, delatches all of the other previously latched push buttons, including an air conditioning or other control button having a push-push latching action. The delatching mechanism is preferably operative to displace and disable a latching hook which produces the push-push latching action.

In one embodiment, the delatching function is assigned to the OFF push button, and also to the DEFROST push button. Each of the delatching push buttons incorporates a first cam which causes longitudinal sliding movement of a delatch bar. For each delatching push button, there is a cooperating cam follower element on the delatch bar. A second cam on the delatch bar operates a slidable pin which displaces and disables the push-push latching hook. In the same embodiment, the delatching push buttons (OFF and DEFROST) belong to a first group of push buttons, also including other push buttons. There is also a second group of push buttons.

The control device includes separate first and second latching bars, whereby any push button of the first group and any push button of the second group can be individually latched. Only one push button of the first group can be latched at any one time, due to the provision of a first lockout mechanism. Depressing either the OFF or the DEFROST push button unlatches any of the other push buttons in the first group, by direct camming action on the first latching bar. Due to the provision of a second lockout mechanism, only one push button of the second group can be latched at any one time. The delatch bar includes a flange or other member for engaging and delatching the second latching bar. Thus, as previously indicated, depressing either the OFF push button or the DEFROST push button delatches all of the other previously latched push buttons.

As a modified embodiment, the control device can be constructed and arranged so that the delatching function is assigned only to the OFF push button. In the modified construction, the delatch bar has only a single operative cam follower, operable by the first cam on the OFF push button.

BRIEF DESCRIPTION OF THE DRAWINGS

Further objects, advantages and features of the present invention will appear from the following description, taken with the accompanying drawings, in which:

FIG. 49 is a fragmentary enlarged top plan view of a right hand portion of the port plate, with the three right hand push buttons assembled thereon, including the air conditioning control push button having the push-push action, but with the terminal head assembly removed to reveal the push buttons.

FIGS. 50, 51 and 52 are fragmentary enlarged diagrammatic top views of a portion of the air conditioning control push button, with the push-push latching hook thereon, such hook being shown in its unlatched position in FIG. 50, an intermediate depressed position in FIG. 51, and its latched position in FIG. 52.

FIG. 53 is a fragmentary enlarged diagrammatic vertical section, taken through the latch pin and the delatch pin, to show the manner in which the delatch pin disables the push-push latching hook, when the delatch pin is pushed upwardly by the delatch bar.

FIG. 54 is a greatly enlarged diagrammatic view showing the underside of the push-push latch hook, as well as the relative positions of the latch pin and the delatch pin.

DETAILED DESCRIPTION OF ILLUSTRATIVE EMBODIMENTS

Figure 2:
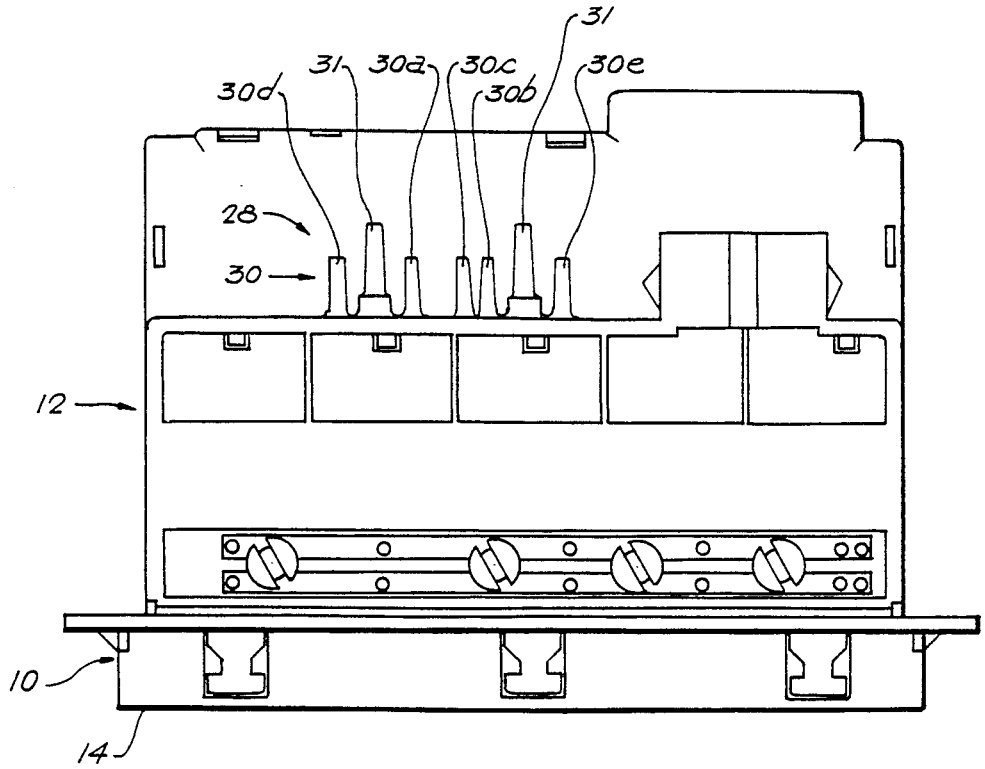
FIG. 2 is a top plan view of the air control device of FIG. 1.
Figure 1:
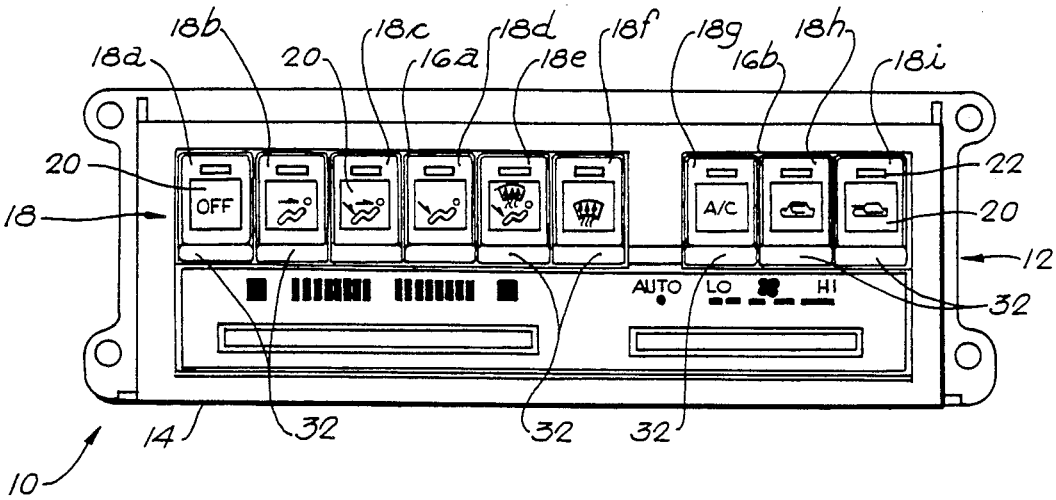
FIG. 1 is a front elevation of a push button vacuum-electric air control device, to be described as an illustrative embodiment of the present invention.

As just indicated, FIGS. 1-5 illustrate the outward appearance of an illustrative embodiment of the present invention in the form of a push button vacuum-electric air control device 10, which may find various applications, but is intended particularly for controlling the operation of an automotive heating, ventilating, and air conditioning system. The control device 10 is adapted to be inserted into a suitable opening in a control panel of an automobile, truck or other vehicle.

The control device 10 has a housing 12, preferably assembled from several parts molded from a suitable resinous plastic material. The housing 12 has a front bezel 14 with openings 16*a* and 16*b* therein for movably receiving a plurality of slidably guided push buttons 18 which are adapted to be depressed rearwardly and returned forwardly, for controlling all of the functions of the control device 10. The number and arrangement of the push buttons 18 may be varied to meet various needs The illustrated control device 10 has nine push buttons 18*a*–18*i*, with markings thereon in the form of legends or symbols, to indicate the control functions assigned to the push buttons. The markings on the push buttons are as follows: 18*a*, OFF; 18*b*, symbol for PANEL VENTS; 18*c*, symbol for BILEVEL, meaning the combination of panel vents and floor vents; 18*d*, symbol for FLOOR; 18*e*, symbol for a combination of DEFOG and FLOOR; 18*f*, symbol for DEFROST; 18*g*, A/C meaning air conditioning; 18*h*, symbol for RECIRCULATE; and 18*i*, symbol for OUTSIDE AIR.

The markings on the push buttons 18*a*–18*i* are displayed on translucent window panels 20 thereon which are back-lighted by light derived from an illuminating system including lamps and transparent plastic light bars, to be briefly described later. Each of the push buttons 18 also has an indicator jewel 22 which is not illuminated when the push button is extended, but is illuminated when the push button is depressed. The indicator jewels 22 may be in the form of small prismatic light bars 23 (FIGS. 83-85) which intercept light beams from the main light bars when the push buttons are depressed.

The control device 10 is constructed so that the push buttons 18 can individually and directly accomplish electrical switching functions or vacuum switching (valving) functions, or both. To provide for electrical connections to the control device 10, it is provided with an electrical terminal assembly 24 including a plurality of electrical terminals such as the six illustrated prongs 26, adapted to receive an electrical connector for establishing electrical connections to the electrical system, which may include a battery, an electrical blower motor, an electrically operable air conditioning clutch, and a solid state electronic switching unit, for switching all of the other components, all not shown. The electronic switching unit performs its switching functions under the control of the control device 10, so that only small control currents or signals need to be switched by the control device 10. The electrical terminal assembly 24 projects rearwardly from the housing 12 of the control device, as shown in FIGS. 2 and 3.

Figure 3:
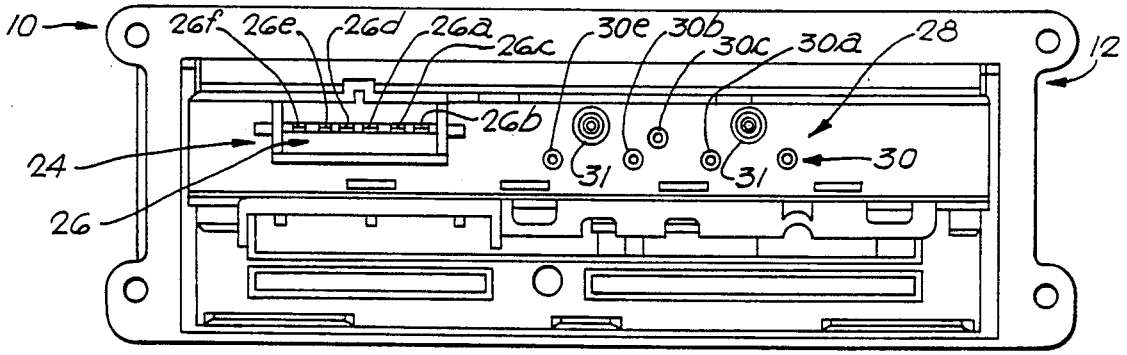
FIG. 3 is a rear elevation of the control device.
Figure 4:
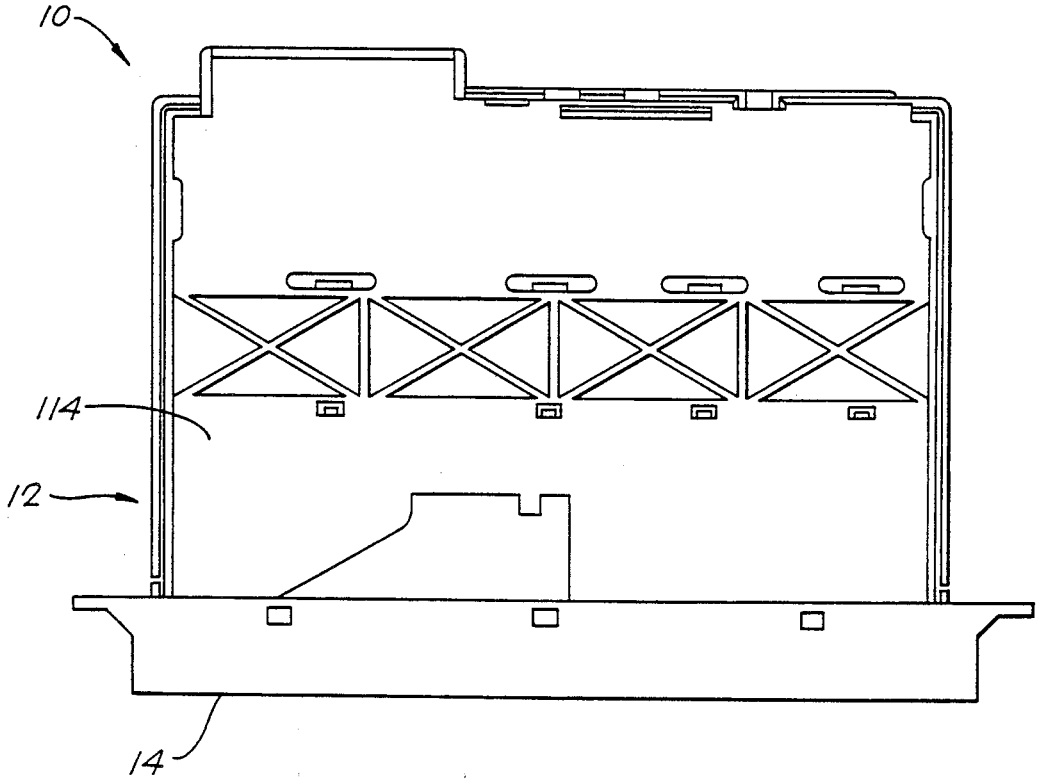
FIG. 4 is a bottom plan view of the control device.
Figure 5:
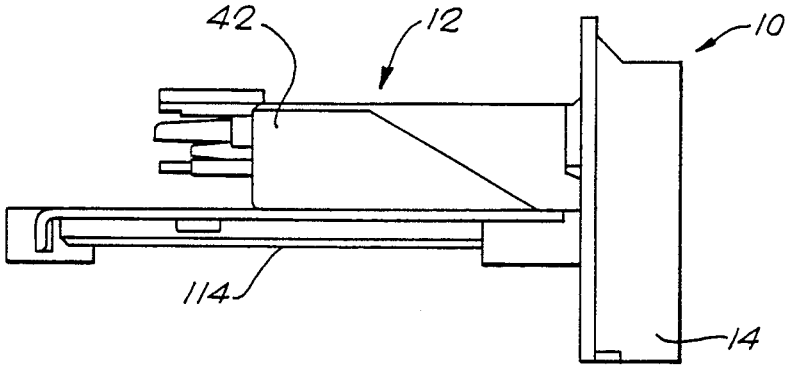
FIG. 5 is a left side elevation of the control device.

As shown in FIG. 3, the six individual electrical terminals are designated 26*a*–26*f* for the purposes of specific identification and detailed description. The terminals 26*a*–26*f* are also shown in the schematic electrical circuit diagram of FIG. 69. The electrical connector is adapted to establish the following electrical control connections to the electrical terminals: 26*a*, OFF signal line to the electronic switching unit; 26*b*, FLOOR blower signal line; 26*c*, A/C (air conditioning) clutch signal line; 26*d*, signal ground; 26*e*, lamp V+ voltage source; and 26*f*, lamp dimmer. The lamp terminals 26*e* and 26*f* provide energization for the electrical lamps 27 associated with the control device 10, for such lamps being shown in FIG. 69. Such lamps provide the internal illumination for the translucent window panels 20 and the indicator jewels 22 of the push buttons 18, as well as providing other illumination.

The control device 10 is also provided with a vacuum terminal assembly 28, also projecting from the rear of the housing 12, and comprising a plurality of vacuum terminals, illustrated as five nipple-shaped ports 30, adapted to receive a vacuum connector, not shown, whereby vacuum is supplied to the control device 10 and is distributed from the control device to the various vacuum motors or operators, for moving the various air diverters and doors in the heating, ventilating and air conditioning system. The vacuum terminal assembly 28 also includes two large nipple-shaped locating posts 31.

As shown in FIG. 3, the five nipple-shaped vacuum terminals or ports are individually designated 30*a*–30*e* for the purposes of individual identification and detailed description. The vacuum devices and components to which the ports are connected may be identified as follows: 30*a*, vacuum source; 30*b*, partial floor; 30*c*, full floor; 30*d*, panel; and 30*e*, recirculate. The vacuum is derived from the intake manifold of the vehicle engine. The distribution ports 30*b*–30*e* selectively supply the vacuum to the various vacuum motors which operate the air diverters and doors to distribute the air from the blower to the floor air outlets, the panel air outlets, and the windshield air outlets used for the defog and defrost functions. The recirculate diverter switches between conditions in which outside air is drawn into the cab, or, alternatively, the air in the cab is merely recirculated.

It will be understood that the details of the electrical terminal arrangement and the vacuum terminal arrangement may be changed to produce a variety of control devices which will accomplish many different groups of electrical and vacuum control functions.

Figure 69:
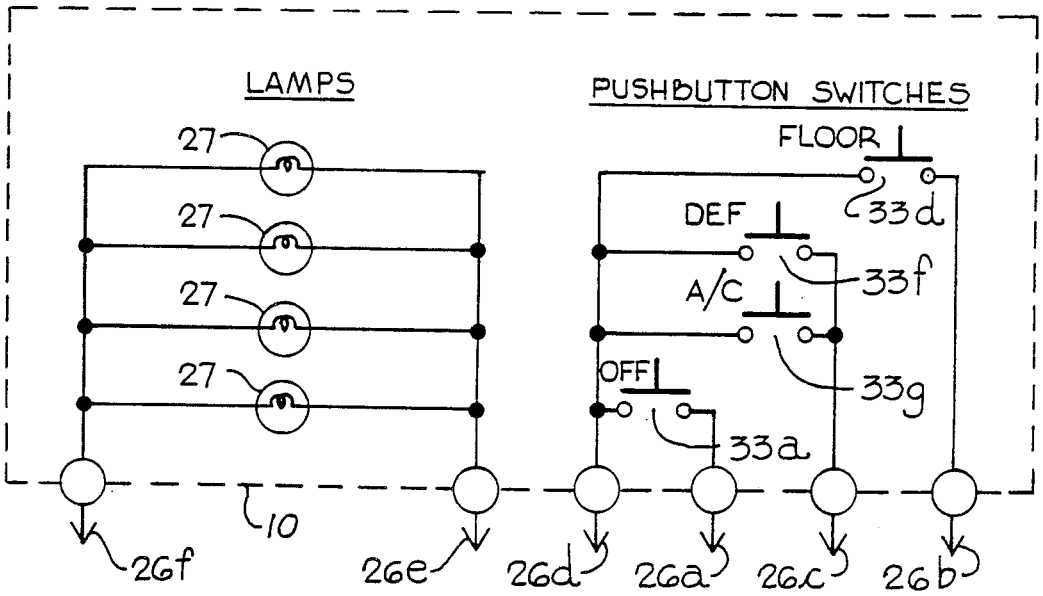
FIG. 69 is a schematic circuit diagram illustrating the electrical switching and lighting circuits for the control device.

As shown diagrammatically in the electrical schematic circuit diagram of FIG. 69, four of the push buttons 18 are constructed and arranged to operate four normally open electrical switches 33*a*, operable by the OFF push button 18*a*; 33*d*, operable by the FLOOR push button 18*d*; 33*f*, operable by the DEFROST push button 18*f*; and 33*g*, operable by the A/C push button 18*g*. The OFF switch 33*a* is connected between the signal line terminal 26*a* and the signal ground terminal 26*d*. The FLOOR terminal 33*d* is connected between the signal line terminal 26*b* and the terminal 26*d*.

The DEFROST switch 33*f* is connected between the signal line terminal 26*c* and the signal ground terminal 26*d*. This is also true of the A/C switch 33*g*, which is connected in parallel with the DEFROST switch 33*f*. Thus, both the DEFROST switch 33*f* and the A/C switch 33*g* are operable to energize the air conditioning system, through the switching operations performed by the electronic switching unit. The other push buttons, not mentioned in the above compilation, do not perform any electrical switching function. It will be understood that the electrical switching functions produced by the push buttons may be varied to suit the needs of various air control systems.

Each of the push buttons 18 could be molded in one piece from a suitable resinous plastic material However, for convenience of manufacture and assembly, it is preferred to make each of the push buttons in a plurality of pieces which are easily assembled. Thus, each of the illustrated push buttons 18 comprises a hollow push button cap 32, shown in FIGS. 1, 25 and 27. In each case, the cap 32 is easily assembled on the front end of a push button shaft 34. All of the push button caps 32 are preferably the same in construction. The translucent windows 20, with their different markings for the various push buttons 18, are assembled into the push button caps 32, as are the transparent plastic jewels 22, which are the front ends of light bars.

All of the push button shafts 34 are preferably the same in construction, as illustrated in FIGS. 17–24. FIGS. 25–30, 49, 50, and 66–68 show assemblies involving the push button shafts 34 and other cooperating components of the control device 10.

As shown in FIGS. 17–22, each of the push button shafts 34 has a front portion or head 36 upon which the corresponding cap 32 is slidably assembled and is securely retained by detents 38 Each push button shaft 34 has a rear portion 40 which will also be referred to as a carriage or carriage member, because it is adapted to carry an electrical contactor and a valve member, to be described presently.

The carriage member 40 is also adapted to carry the push-push latching hook for the A/C push button 18*g*, as will also be described presently.

All of the carriage members 40 for the push buttons 18 are slidably mounted on a port plate member 42 constituting a component of the housing 12, as shown in FIGS. 25–28 and 66–68, so that the push button shafts 34 are slidable to a limited extent from front to rear between extended and depressed positions, both of which are shown in FIGS. 25–28. The push button shafts 34 are spring biased toward their extended positions by spring means, illustrated as nine individual compression coil springs 44, each of which is located and lightly detained in a generally semicylindrical nest 46, formed in a laterally offset position on the rear portion of the corresponding carriage member 40. It will be clearly seen from FIG. 21 that the nest 46 is laterally offset in one direction from the center line of the push button shaft 34. Moreover, the nest 46 is offset in a forward direction from the rear end of the carriage 40. This construction has the advantage of positioning the corresponding coil spring 44 with its front portion located a considerable distance from the rear end of the carriage member 40, so that a relatively long coil spring can be accommodated, while minimizing the total depth of the control device 10.

Figure 17:
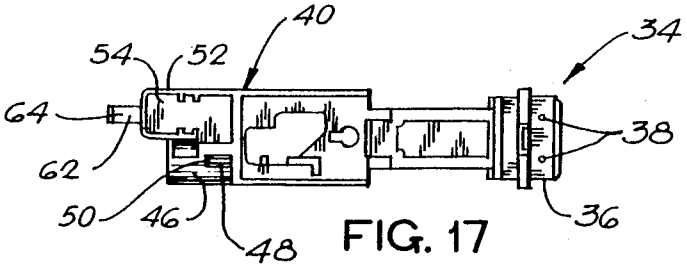
FIG. 17 is a top plan view of a push button shaft, the construction of which is the same for all of the push buttons of the control device.
Figure 21:
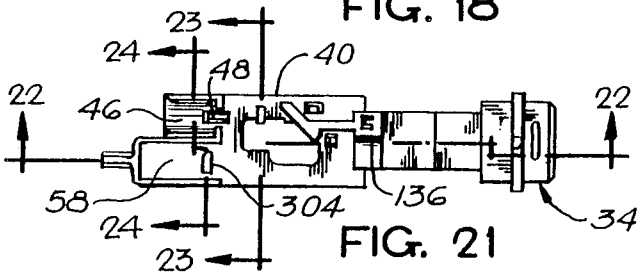
FIG. 21 is a bottom plan view of the push button shaft.
Figure 22:
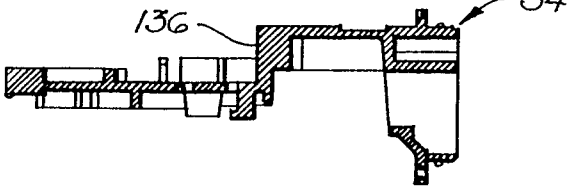
FIG. 22 is a longitudinal vertical section, taken generally along the line 22—22 in FIG. 21.
Figure 20:
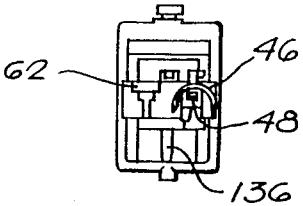
FIGS. 19 and 20 are front and rear elevations of the push button shaft.
Figure 19:
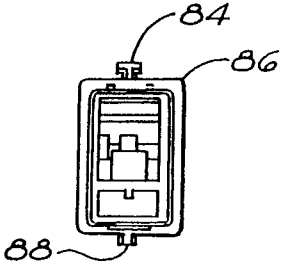
Figures 23, 24:
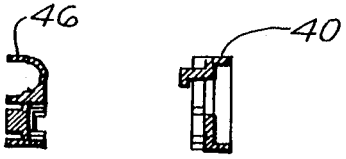
FIGS. 23 and 24 are vertical cross sections, taken generally along the lines 23—23 and 24—24 in FIG. 21.

Each coil spring 44 is lightly detained in the corresponding semicylindrical nest 46 by detent means, illustrated in FIGS. 17, 20 and 21 as a detent finger 48, projecting rearwardly on the carriage member 40 into the interior of the nest 46, and adapted to extend into the interior of the corresponding coil spring 44, so that one or more of the forwardly disposed coils of the spring 44 are lightly captured and detained between the detent finger 48 and the nest 46. To increase the detaining action, the illustrated detent finger 48 is formed with an upwardly projecting detent ridge 50, extending transversely across the detent finger 48 at its rear end. The detent finger 48 has the advantage of detaining the coil spring 44 in the nest 46 on the carriage member 40 while the control device 10 is being assembled, to facilitate its assembly.

Figures 70, 71, 72, 73, 74, 75, 76, 77, 78, 79, 80, 81, 82, 83, 84, 85:
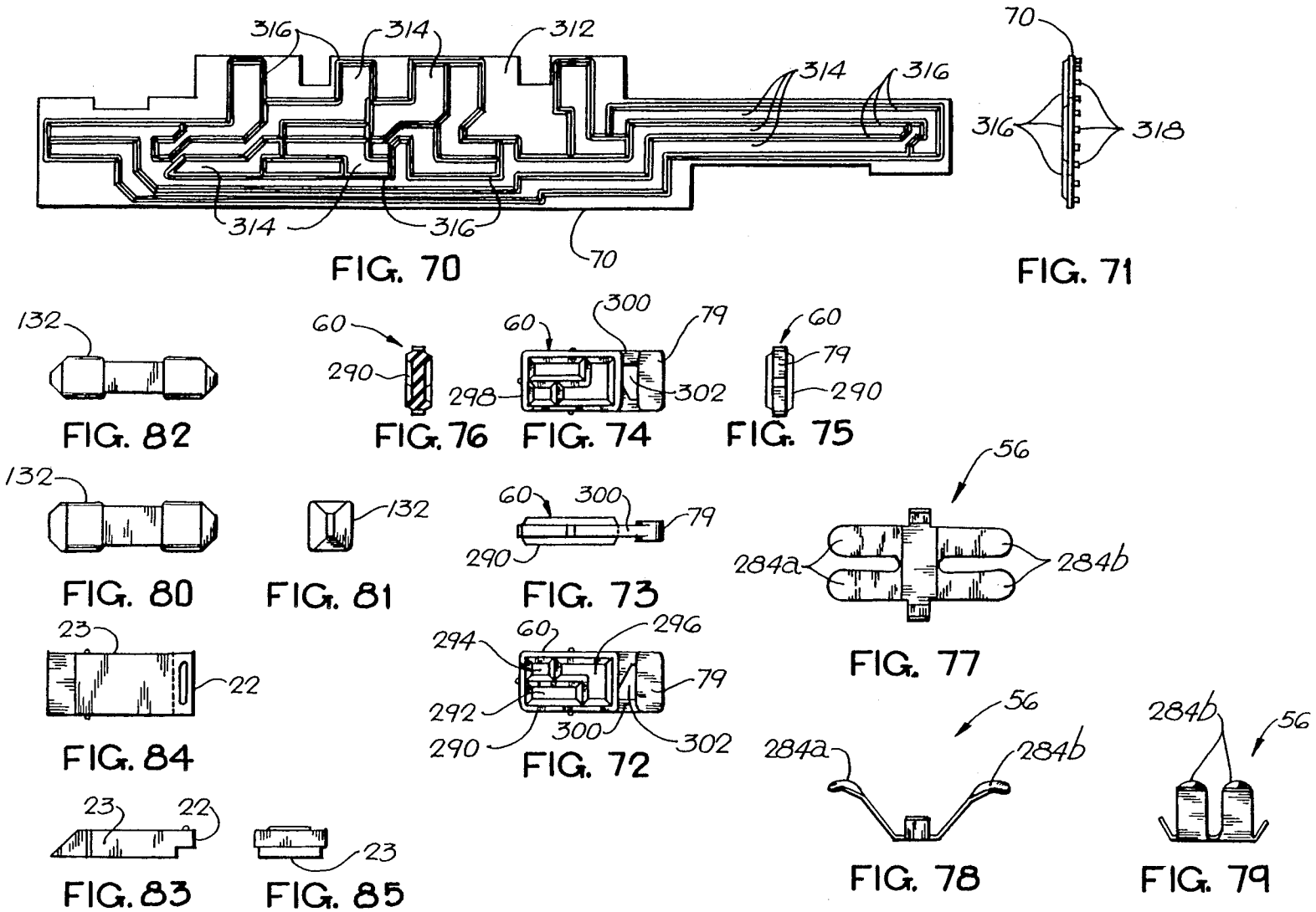
FIG. 70 is a top view of the silicone rubber vacuum distribution manifold for the control device.
FIG. 71 is an end view of the manifold.
FIG. 72 is a bottom view of one of the silicone rubber valve members for the control device.
FIG. 73 is a side view of the valve member.
FIG. 74 is a top view of the valve member.
FIG. 75 is an end view of the valve member.
FIG. 76 is a cross section taken through the valve member.
FIG. 77 is a top plan view of one of the electrical contactors for the control device.
FIG. 78 is a side elevation of the electrical contactor.
FIG. 79 is an end elevation of the electrical contactor.
FIG. 80 is a front elevation of one of the lockout blocks for the control device.
FIG. 81 is an end view of the lockout block.
FIG. 82 is a top plan view of the lockout block.
FIG. 83 is a side elevation of one of the light bars for the push buttons of the control device.
FIG. 84 is a top view of the light bar.
FIG. 85 is an end view of the light bar.

Each carriage member 40 has a rear or main portion 52 having its upper side formed with a contactor recess 54, for receiving an electrical contactor 56 (FIGS. 17 and 27), shown in the general form of a leaf spring to afford its own spring biasing force. The underside of the main carriage portion 52 is formed with a valve recess 58 for receiving the valve member 60 (FIGS. 21 and 72). Preferably, the valve member 60 is platelike in form and is made of a soft resilient material, such as silicone rubber, as will be described in greater detail presently. It will be seen from FIG. 17 that the main or rear carriage portion 52 is offset laterally from the center line of the carriage 40, in a direction which is opposite from the laterally offset direction of the semicylindrical nest 46, which is alongside and connected with the main carriage portion 52, as also will be evident from FIG. 21.

Figure 18:
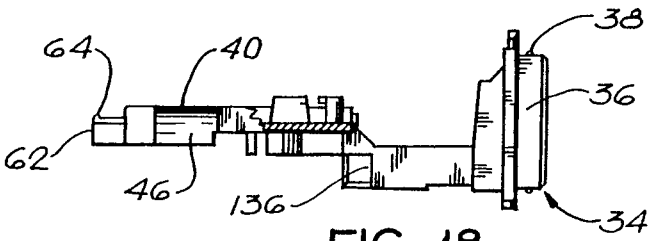
FIG. 18 is a left side elevation of the push button shaft of FIG. 17.

A guide flange or tongue 62 projects rearwardly from the main carriage portion 52 and is adapted to form one component of a tongue-and-slot guiding arrangement or means, to be described in greater detail presently. As shown in FIGS. 17, 18 and 20, the illustrated tongue 62 is T-shaped in cross section and is formed with an upwardly projecting transverse bead 64 at its rear end.

Figure 9:
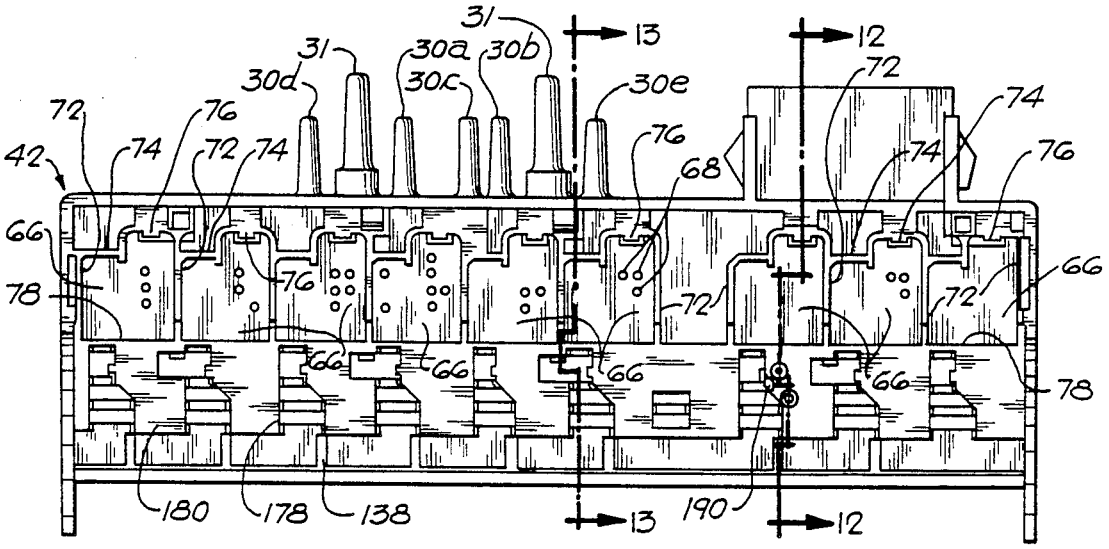
FIG. 9 is a top plan view of the port plate.
Figure 8:
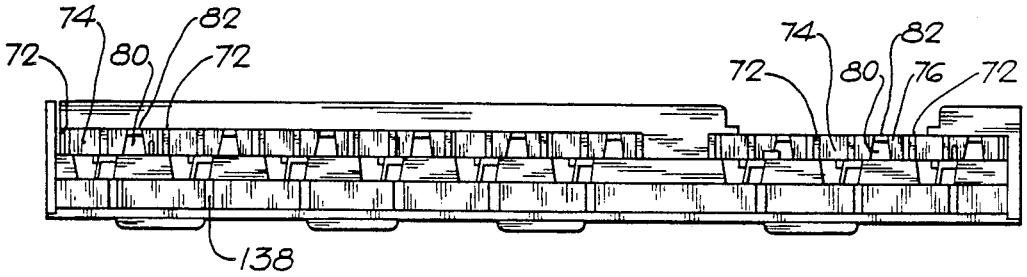
FIG. 8 is a front elevation of a port plate which is a component of the housing for the control device.

The details of the port plate member 42 are shown in FIGS. 8–13, while the assembled relation of the port plate member 42 and the push buttons 18 is shown in FIGS. 25–28. As shown in FIG. 9, the port plate member 42 has a series of nine smooth upwardly facing valve surfaces 66, adapted to be slidably engaged by the valve members 60 on the push button carriage members 40. Some or all of the smooth valve surfaces 66 are formed with variously arranged valve ports 68 which extend downwardly through the port plate member 42 and communicate with a vacuum distribution manifold 70, shown in detail in FIGS. 70 and 71. The manifold 70 is preferably made of a soft resilient material, such as silicone rubber.

In this case, all of the valve surfaces 66 have variously arranged groups of the valve ports 68, with the exception of the surfaces 66 which cooperate with the A/C push button 18*g* and the outside air push button 18*i*, which are not assigned any valving functions. However, for the sake of uniform operating feel, all of the push buttons 18*a*–18*i* are fitted with their own valve members 60, which are nonfunctional in the two locations where valve ports are not provided.

The nine valve surfaces 66 are recessed into the upper side of the port plate member 42 and are surrounded by guide means or structures for slidably guiding the push button carriages 40, to guide them along their paths of sliding movement from front to rear. The guide structures take the form of flanges or walls projecting upwardly from the valve surfaces 66. In the case of each valve surface 66, such guide walls include a pair of side walls 72, for slidably guiding the sides of the corresponding carriage 40; a first rear wall portion 74 engageable by the corresponding coil spring 44; a second rear wall portion 76, offset rearwardly from the first rear wall portion 74, and a front wall 78, serving as a front stop to limit the forward movement of the corresponding push button 18. Each rubber valve member 60 has a front portion or tab 79, acting as a soft pad for engagement with the front wall 78 to minimize the noise produced when the push button 18 is returned outwardly by its return spring 44. In each case, the second rear wall portion 76 is formed with a slot 80 for receiving the corresponding tongue 62. It will be seen from FIG. 8 that each slot 80 is oversize laterally and is non-rectangular in shape, but the upper end of the slot 80 is bounded by a horizontal wall or flange 82, along which the bead or ridge 64, projecting upwardly on the tongue 62, is smoothly slidable, to hold the tongue 62 down, so that the valve member 60 will be compressed lightly into sealing engagement with the corresponding valve surface 66. A precision sliding fit is provided between the bead 64 and the horizontal wall or flange 82. There is a free sliding fit between each push button carriage 40 and the corresponding pair of side walls 72. The wall or flange 82 is adapted to limit the rearward movement of the corresponding main carriage portion 52.

Figure 88:
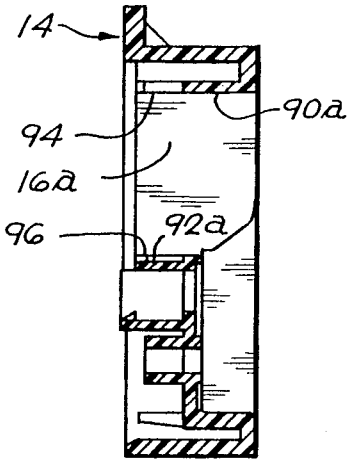
FIG. 88 is a vertical cross section, taken through the bezel, generally along the line 88—88 in FIG. 87.
Figure 87:
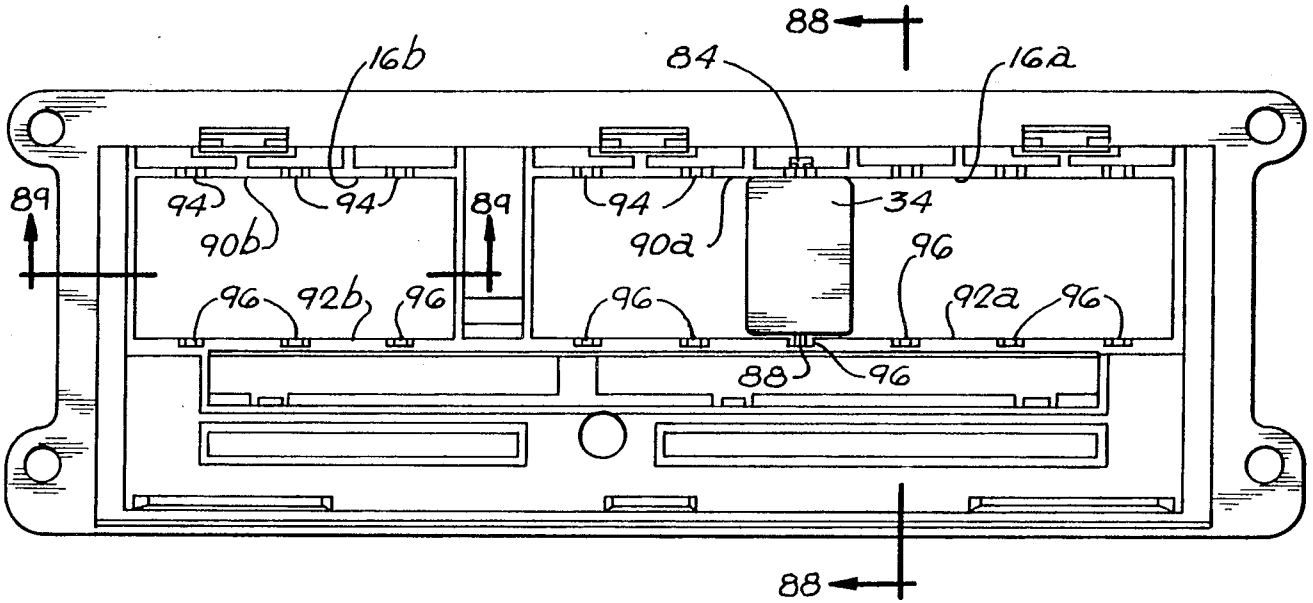
FIG. 87 is a rear elevation of a bezel, forming the front component of the housing for the control device.
Figure 89:
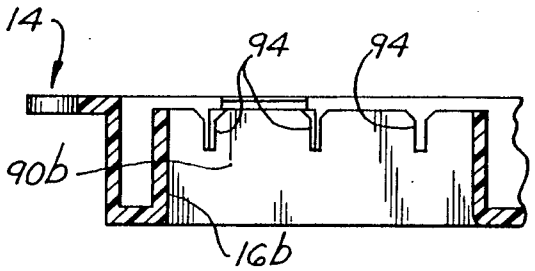
FIG. 89 is a fragmentary horizontal section, taken through the bezel, generally along the line 89—89 in FIG. 87.

The control device 10 is also provided with guide means for slidably guiding the front portion or head 36 of each push button shaft for controlled sliding movement in a front to rear direction. In the illustrated construction, such guide means comprise elements on the head 36 of the push button shaft 34, and cooperating elements on the bezel 14, particularly as illustrated in FIGS. 87–89. The guide elements on the head 36 of each push button shaft 34, as shown in FIGS. 17–22, take the form of a generally T-shaped upper flange or tab 84, projecting upwardly from a peripheral flange 86 on the head 36, and a lower guide tab 88, projecting downwardly from the peripheral flange 86.

It will be recalled that the bezel 14 has two generally rectangular openings **16*a* and 16*b* therein for receiving the first and second groups of the push buttons 18. Such openings 16*a* and 16*b* are shown from the rear in FIG. 87. The openings 16*a* and 16*b* have upper boundary walls or flanges 90*a* and 90*b*, as well as lower boundary walls or flanges 92*a* and 92*b*. The upper boundary walls 90*a* and 90*b* are formed with a total of nine guide slots 94, for receiving the T-shaped upper guide tabs 84 on the front portions or heads 36 of the push button shafts 34. The lower boundary walls 92*a* and 92*b* are formed with a total of nine guide grooves 96, for slidably receiving the lower guide tabs 88 on the push button shafts 34. The upper and lower guide tabs 84 and 88 are inserted into the guide slots 94 and the guide grooves 96 from the rear side of the bezel 14, during the assembly of the control device 10. There is a free but accurate sliding fit between the upper and lower guide tabs 84 and 88 and the respective guide slots 94 and guide grooves 96, so that the push buttons 18 are accurately guided, to maintain the required slidable sealing engagement between the silicone rubber valve members 60 and the stationary valve surfaces 66 on the port plate member 42**.

As previously indicated, the first six push buttons **18*a*–18*f* (FIG. 1) constitute a first group having a first latching mechanism or means 98, to be described presently, whereby any single push button of the group can be latched in its depressed position at any one time. Depressing any particular push button of the group causes the first latching mechanism to unlatch any previously depressed push button and then to latch the particular push button which is being depressed currently. There is also a first lockout mechanism or means 100, to be described presently, which prevents the depression of more than one push button of the first group at any one time. In general, such latching and lockout mechanisms are known to those skilled in the art, and various mechanisms could be employed in the present control device 10**.

The seventh or A/C push button **18*g* is unique, in that it has a push-push latching action, produced by a push-push latching mechanism or means 102**, to be described presently, whereby it is latched in a depressed position, when first pushed, while being released to its extended position, when pushed for a second time.

The eighth and ninth push buttons **18*h* and 18*i* constitute a second group having a second latching mechanism or means 104, whereby either of the push buttons can be latched in its depressed position, while unlatching the other push button. There is also a second lockout mechanism or means 106, to be described presently, whereby only one of the two push buttons 18*h* and 18*i*** can be depressed at any one time.

In accordance with another feature of the present invention, the control device 10 also includes a delatching mechanism 108, to be described presently, whereby depressing a predetermined push button has the effect of delatching all of the other push buttons, which might have been latched previously. The predetermined push button may be described as the delatching push button. There may be more than one delatching push button. In the illustrated control device 10, the OFF push button **18*a* and the DEFROST push button 18*f* serve as delatching push buttons, serving to delatch all of the other push buttons, if either of them is individually depressed. As another alternative construction, the delatching mechanism 108 may be modified so that only the OFF push button 18*a* serves as the delatching push button. The delatching mechanism 108 is effective to delatch the A/C push button 18*g***, as well as the push buttons of the first and second groups, previously referred to.

Figure 6:
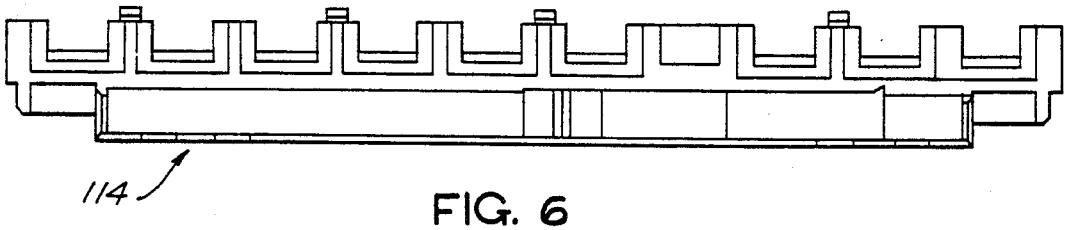
FIG. 6 is a front elevation of a bottom cover for the housing of the control device.
Figure 7:
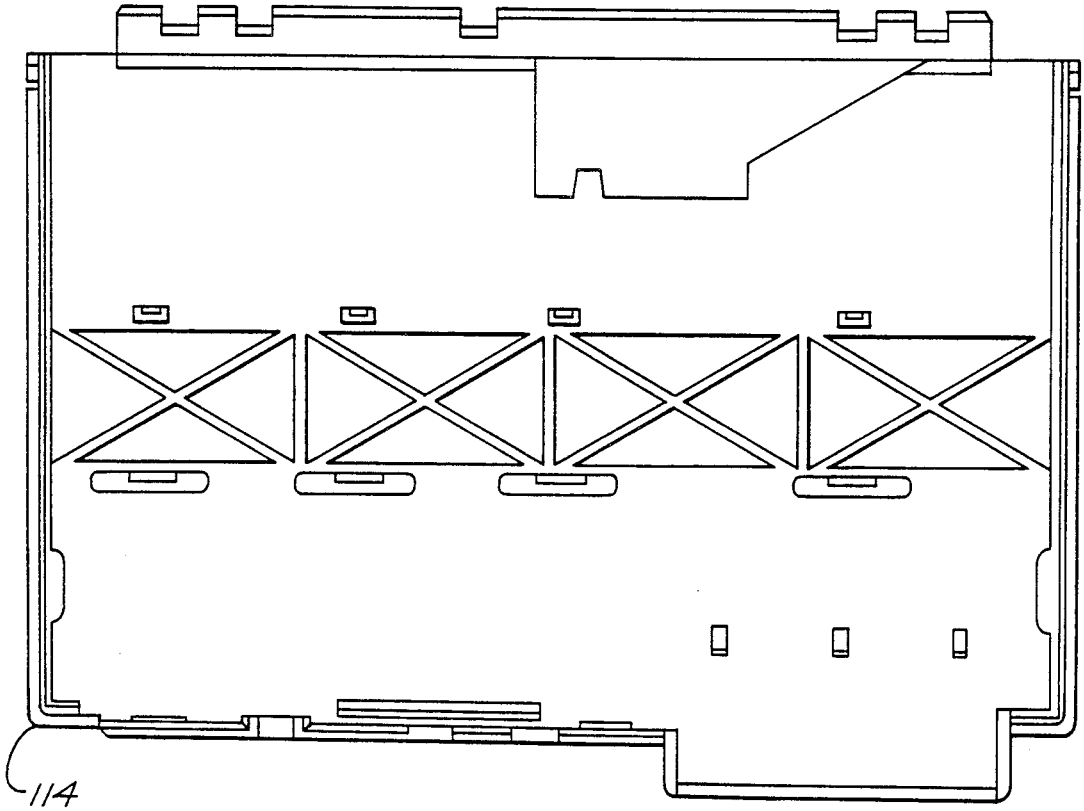
FIG. 7 is a bottom plan view of the bottom housing cover of FIG. 6.
Figure 10:
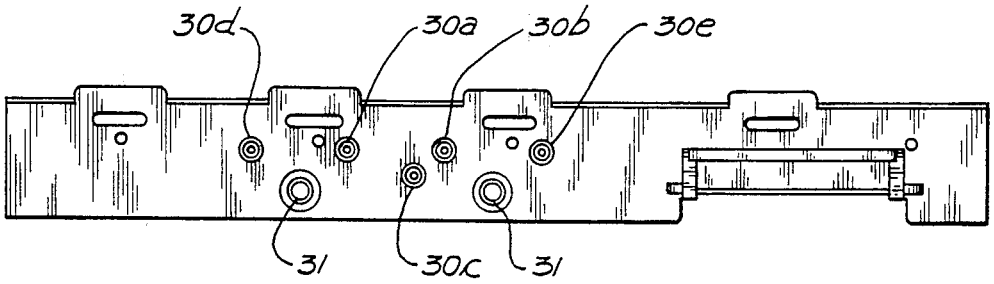
FIG. 10 is an inverted rear elevation of the port plate.

Various details of the first latching mechanism 98 are shown in FIGS. 27–35, 45 and 46. The first latching mechanism 98 includes a first latching bar 110 which is slidable transversely in a channel 112 (FIGS. 27–30, 45, 46) formed in the underside of the port plate member 42. The latching bar 110 is slidably contained in the channel 112 by a lower cover member 114 (FIGS. 4, 6 and 7) of the housing 12 and is biased in one direction of its sliding movement by spring means, illustrated in FIGS. 29, 30, 45 and 46 as a compression coil spring 116, nested into a recess 118 in the port plate member 42, and compressed between the port plate member 42 and one end of the first latching bar 110.

The latching bar 110 has six upwardly projecting latch tabs 120 for individually latching the six push buttons **18*a*–18*f* of the first group. Each latch tab 120 has a diagonal actuating ramp or follower 122, whereby the latching bar 110 is displaced by the depression of each of the six push buttons 18*a*–18*f***.

Each of the push button shafts 34, which are all the same, has a downwardly projecting latching tooth which latches behind the corresponding latch tab 120, when that particular push button is depressed. Each latching tooth 124 has oppositely sloping ramps or cams 126 and 128, for successively engaging the corresponding latch tab 120, when the corresponding push button is depressed, and a latching shoulder 130, adapted to latch behind the corresponding latch tab 120.

Figure 28:
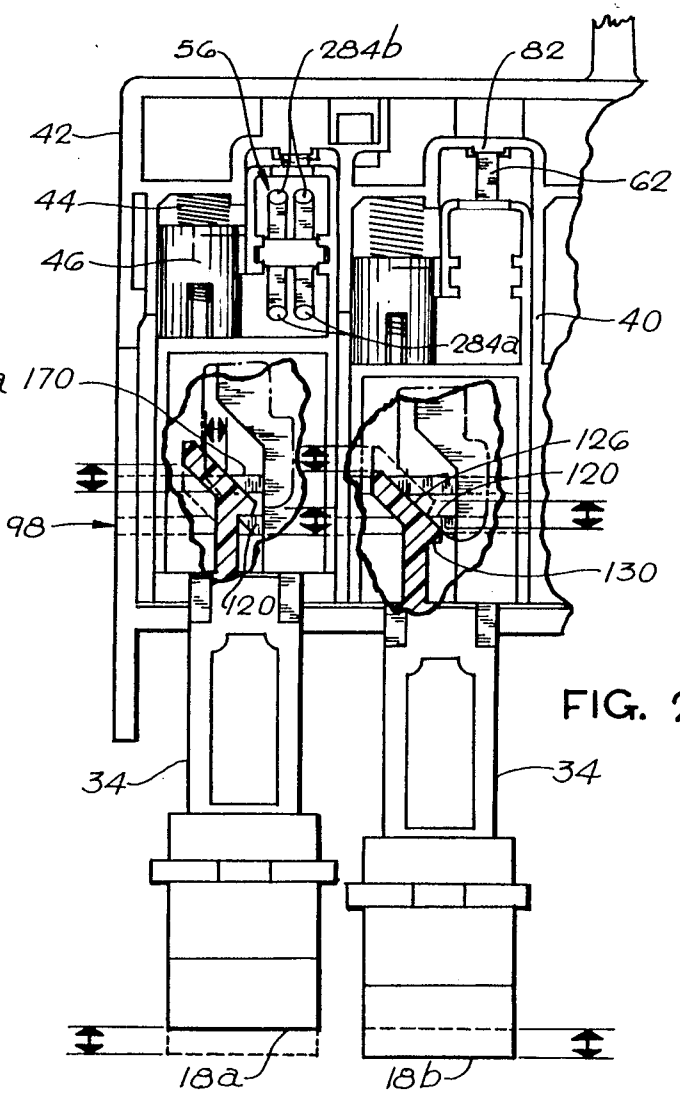
FIG. 28 is a fragmentary enlarged diagrammatic plan view, similar to FIG. 27, but showing the first or OFF push button in its depressed position, in which it is latched by the first latching bar, while the second push button is unlatched and extended, the view also showing the operation of the delatch bar by a cam element on the first push button shaft.
Figure 27:
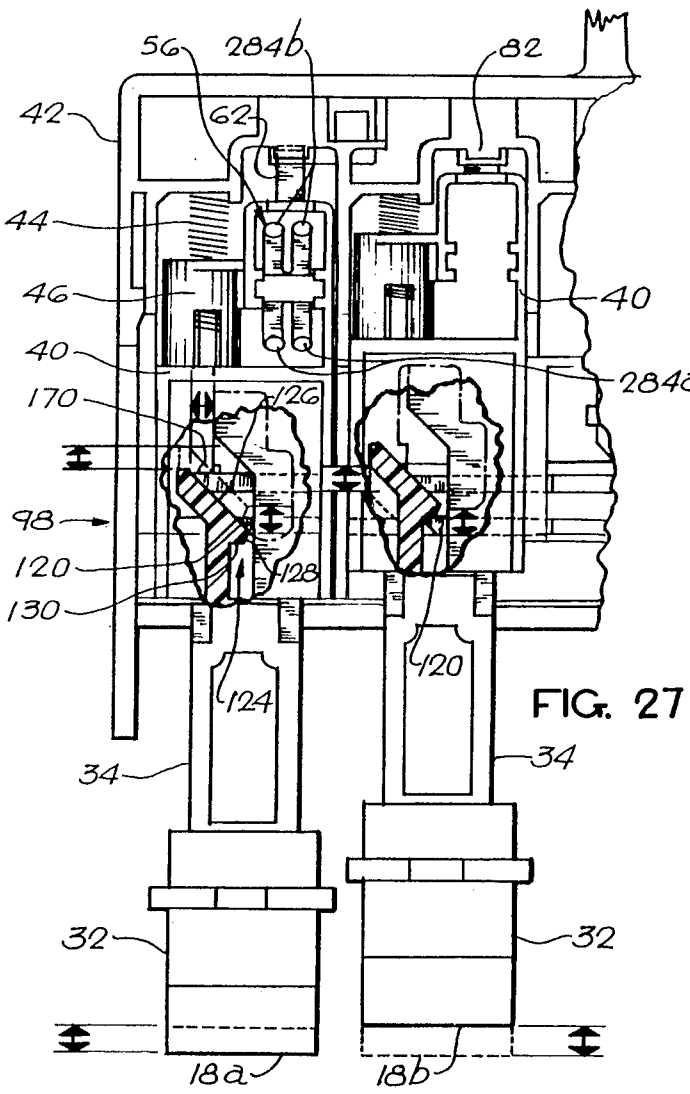
FIG. 27 is a fragmentary enlarged diagrammatic plan view, similar to the left hand portion of FIG. 25, but with portions of the structure broken away and shown in section, to illustrate the latching of the second push button by a first latching bar.

FIGS. 27 and 28 include a diagrammatic representation of the latching teeth 124 for the first two push buttons 18*a* and 18*b*, which constitute representative push buttons of the first group comprising the push buttons 18*a*–18*f*. In FIG. 27, the second push button 18*b* is depressed and latched, while the first push button 18*a* is extended and unlatched. In FIG. 28, the situation has been reversed, in that the first push button 18*a* is depressed and latched, while the second push button 18*b* is extended and unlatched. When the first push button 18*a* is depressed, its first ramp or cam 126 engages the corresponding ramp 122 on the first latching bar 110 and displaces the latching bar to the right, far enough to unlatch the second push button 18*b*. When the depression of the first push button 18*a* is completed, the corresponding latch tab 120 travels along the second ramp or cam 128 and moves to the left, because of the action of the latching bar spring 116, so that the latch tab 120 moves into its latching position, behind the corresponding latching shoulder 130, as shown in FIG. 27.

In general, depression of any of the six push buttons 18*a*–*f* of the first group unlatches any previously depressed push button of this group, and then causes latching of the currently depressed push button.

Figures 45, 46, 47, 48:
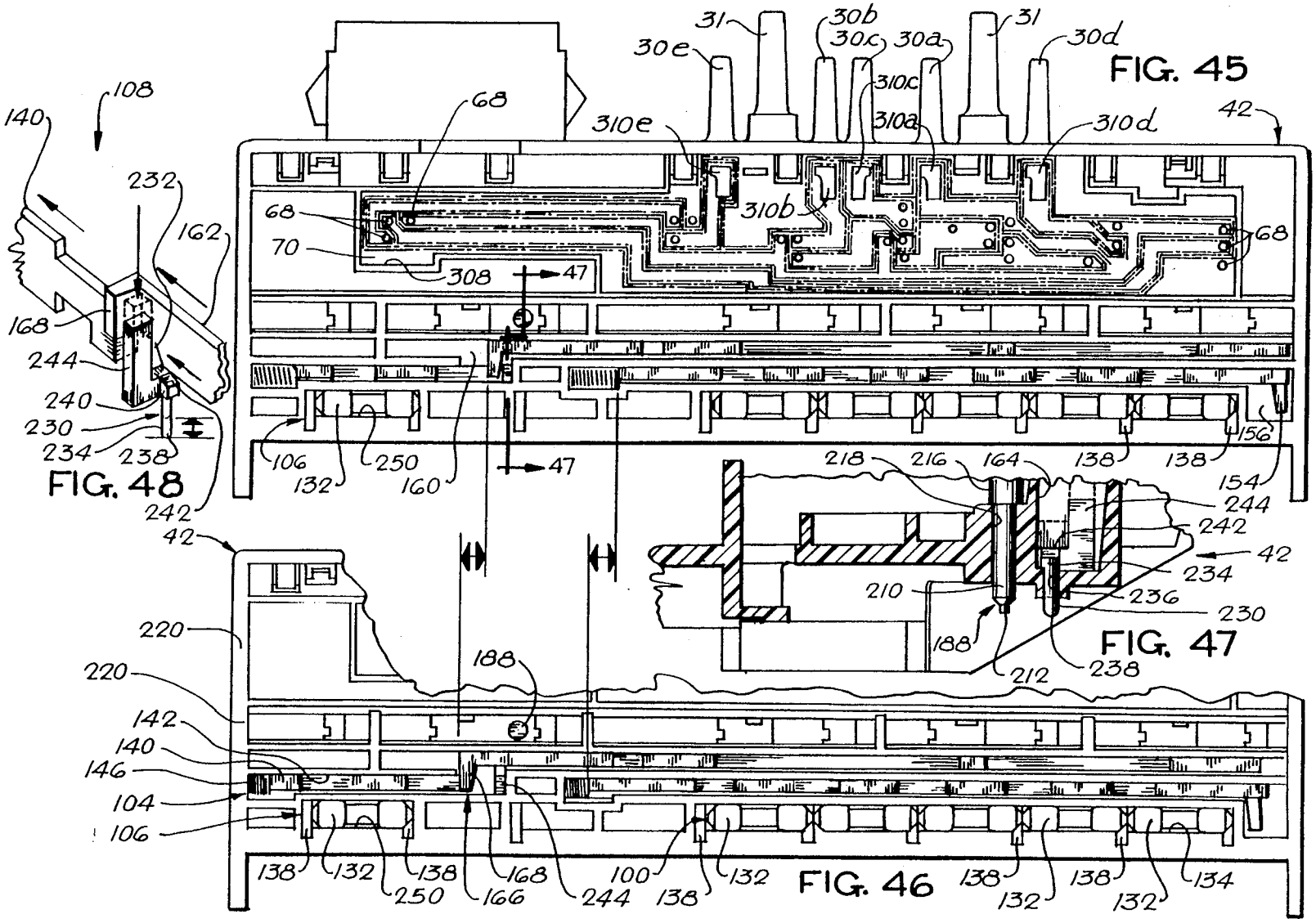
FIG. 45 is a bottom view of the port plate, with various components assembled thereon, including the first and second latching bars, the delatch bar, two sets of lockout blocks, return springs for the latching bars, a latch pin, a delatch pin, and a vacuum distribution manifold, but with the bottom cover removed to reveal the assembled components.
FIG. 46 is a fragmentary bottom view, similar to a portion of FIG. 45, but with the latching bars and the delatch bar in changed positions, to which they are moved by the depression of the OFF or DEFROST push button.
FIG. 47 is a fragmentary enlarged inverted vertical section, taken generally along the line 47—47 in FIG. 45 and showing the latch pin and the delatch pin.
FIG. 48 is a fragmentary diagrammatic enlarged perspective view, showing the manner in which the delatch bar operates the delatch pin, the components being shown inverted.

As shown in FIGS. 45 and 46, the first lockout mechanism 100 comprises five lockout blocks 132 which are arranged in a row and are slidably received in a transverse channel 134, formed in the underside of the port plate member 42, and located forwardly of the channel 112 for the first latching bar 110. The lockout blocks 132 are slidably contained in the channel 134 by the lower cover member 114 of the housing 12. The aggregate length of the five lockout blocks 132 is a certain amount less than the length of the channel 134, so that a clearance space can exist between any adjacent pair of the lockout blocks 132, or between either of the endmost lockout blocks 132 and the corresponding end of the channel 134. As shown in FIGS. 18 and 20–22, each of the push button shafts has a lockout penetrating member or blade 136, extending downwardly and rearwardly thereon, adapted to penetrate and occupy the clearance space with an easy sliding fit. Each lockout penetrating member 136 has a thickness which is only slightly less than the available clearance space, so that there is no possibility that any of the other lockout penetrating members 136 of the other push button shafts 34 can penetrate any of the other spaces along the row of the lockout blocks 132. Thus, only one of the first group of push buttons 18*a*–18*f* can be depressed at any one time. The lockout penetrating members 136 are slidably received in corresponding slots 138, formed in the port plate member, as shown in FIGS. 11, 29, 30, 45 and 46. There are nine of the slots 138, for the nine push buttons 18*a*–18*i*.

The second latching mechanism 104 is similar to the first latching mechanism 98, except that the second latching mechanism 104 makes provision for latching only the eighth and ninth push buttons 18*h* and 18*i*, one at a time.

Thus, the second latching mechanism 104 comprises a relatively shorter latching bar 140 (FIGS. 29, 30, 36–40 and 46) which is slidable transversely in a channel 142, formed in the underside of the port plate member 42, toward the right hand side thereof, when viewed from above, as in FIG. 29, or the left hand side thereof, when viewed from below, as in FIGS. 45 and 46. The second latching bar 140 is slidably contained in the channel 142 by the lower cover member 114 for the housing 12 of the control device 10. The second latching bar 140 is biased to the left as seen from the top, as in FIGS. 29 and 30, by spring means, illustrated as a second compression coil spring 146, nested into a recess 148 in the port plate member 42, and compressed between the port plate member 42 and one end of the second latching bar 140.

The second latching bar 140 has two upwardly projecting latch tabs 150, for individually latching the push buttons 18*h* and 18*i*. Each latch tab 150 has a diagonal actuating ramp or follower 152, whereby the second latching bar 140 is displaced by the depression of each of the push buttons 18*h* and 18*i*.

The latching teeth 124 on the push button shafts 34 for the push buttons 18*h* and 18*i* cooperate with the diagonal ramps 152 of the latch tabs 150 on the second latching bar 140, in the same manner as described in connection with the first latching bar 110. Thus, if either of the push buttons 18*h* and 18*i* is depressed, the other push button is first unlatched, after which the currently depressed push button is latched in its depressed position. The unlatched push button is spring returned forwardly to its extended position.

The first latching bar 110 has a locating tab 154 extending forwardly from one end thereof, into a recess 156 (FIGS. 45 and 46). The locating tab 154 insures that the first latching bar 110 is assembled in the correct position in the channel 112.

The second latching bar 140 has a locating tab 158 thereon which projects forwardly into an opening 160 in the port plate member 42. The locating tab 158, shown most clearly in FIGS. 38–40, insures that the second latching bar 140 is assembled in the correct position in the channel 142.

The delatching mechanism 108, shown generally in FIGS. 29, 30 and 45–48, is illustrated as comprising a delatching bar 162, also shown separately in FIGS. 41–44, which is slidable transversely in a channel 164, formed in the underside of the port plate member 42, and extending parallel with the channel 112 for the first latching bar 110. The delatching bar 162 is slidably contained within the channel 164 by the lower cover member 114 of the housing 12 for the control device 10.

The delatching bar 162 has connecting means adapted to move the second latching bar 140 to a disabled or unlatching position, against the yieldable force of its biasing spring 146, such connecting means being shown in FIGS. 45 and 46 as a flange or tab 168 projecting forwardly from the left hand end of the delatching bar 162, as viewed from below. The tab 168 projects forwardly through the opening 160, which extends between the channel 142 for the second latching bar 140 and the channel 164 for the delatching bar 162. It will be seen that the tab 168 engages the right hand end of the second latching bar 140, when viewed from below, as in FIGS. 45 and 46. By virtue of this arrangement, the biasing spring 146 for the second latching bar 140 also biases the delatching bar 162 to the right, so that the delatching bar occupies the initial position shown in FIG. 45, when the delatching bar is not being operated by any of the push buttons 18. When the delatching bar 162 is being operated by one of the push buttons 18*a* or 18*f*, the delatching bar 162 is moved to the left, as shown from below in FIG. 46, whereby the eighth and ninth push buttons 18*h* and 18*i* are delatched.

In the illustrated construction of the delatching mechanism 108, the delatching bar 162 is adapted to be operated by either the OFF push button 18*a* or the DEFROST push button 18*f*. For this purpose, the delatching bar 162 is provided with two upwardly projecting operating tabs 170 and 172 having respective sloping ramps or followers 174 and 176, as shown in FIGS. 29 and 30, and also in FIGS. 41 and 42, which are top and front views of the delatching bar 162.

Figures 29, 30:
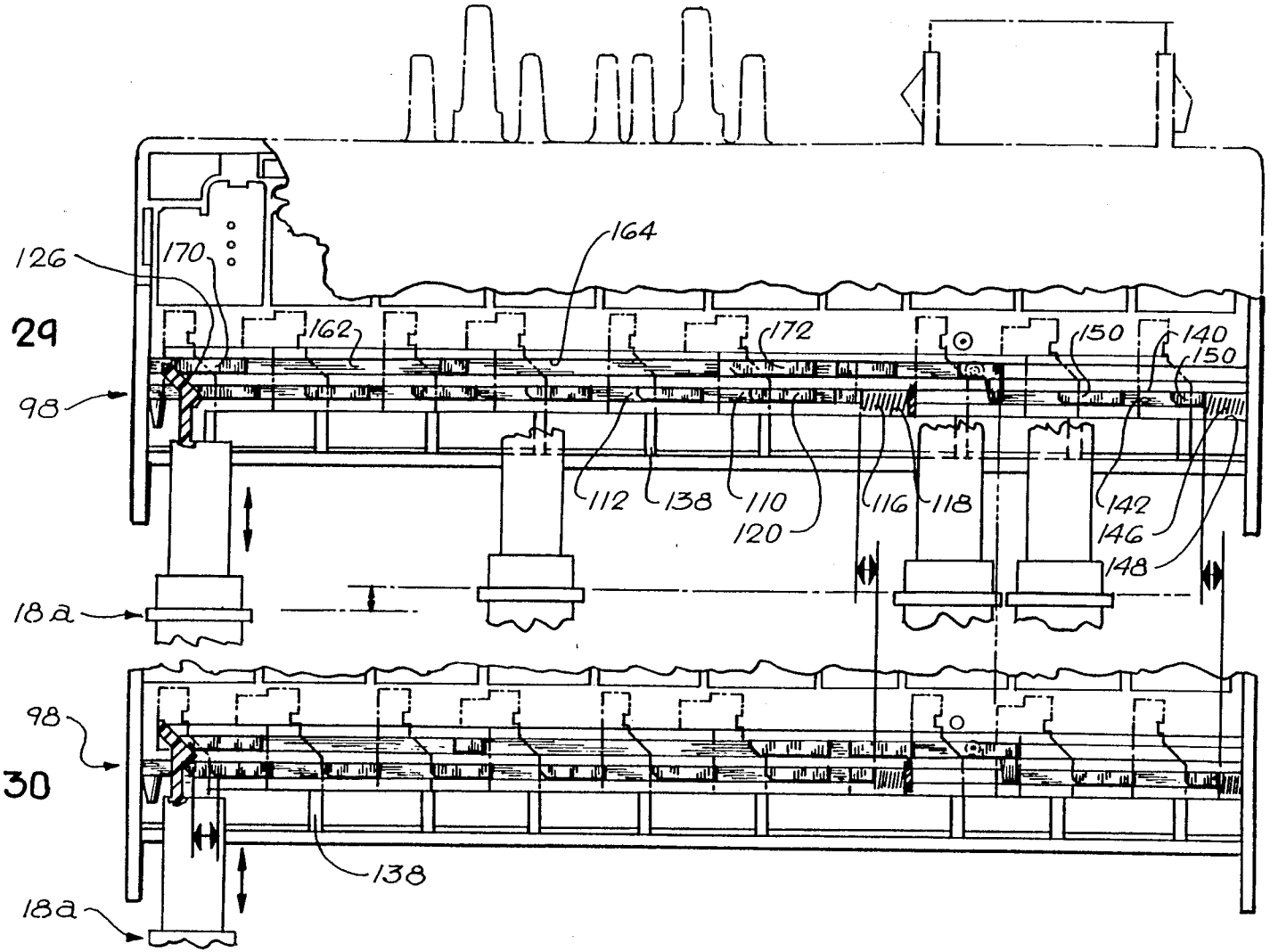
FIG. 29 is a diagrammatic top plan view of the control device, with portions broken away and shown in section, to show the assembled relation of the port plate with certain of the push buttons, and also with the first and second latch bars, the delatch bar and other associated components, the OFF push button being extended, while certain of the other push buttons are depressed.
FIG. 30 is a fragmentary view, somewhat similar to a portion of FIG. 29, but showing the OFF push button depressed.
Figure 31:
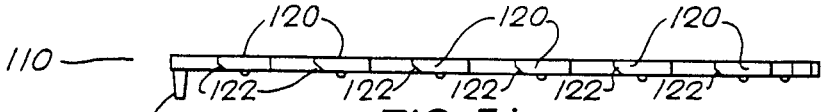
FIG. 31 is a top plan view of the first latching bar.
Figures 32, 33, 34:
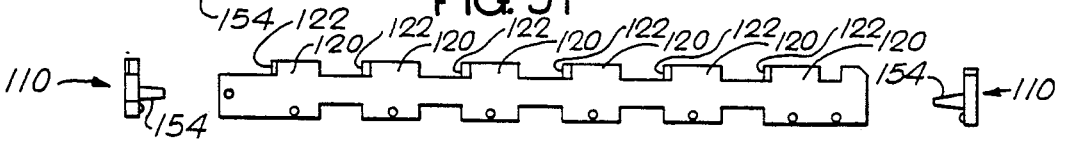
FIG. 32 is a front elevation of the first latching bar.
FIGS. 33–34 are left and right end views, respectively, of the first latching bar.
Figure 35:
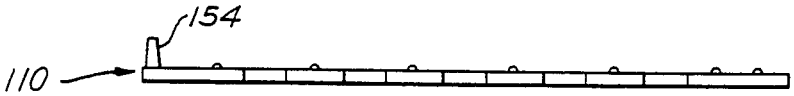
FIG. 35 is a bottom view of the first latching bar.
Figure 36:
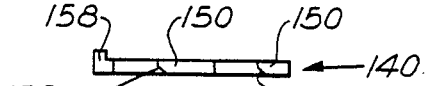
FIG. 36 is a top plan view of the second latching bar for the control device.
Figure 38:
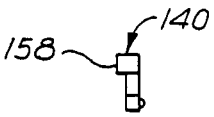
FIGS. 38 and 39 are left and right end views of the second latching bar.
Figure 37:
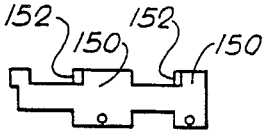
FIG. 37 is a front elevation of the second latching bar.
Figure 39:
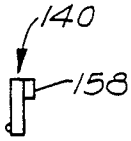
Figure 40:
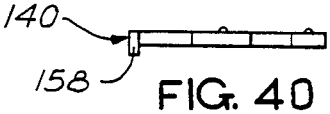
FIG. 40 is a bottom view of the second latching bar.
Figure 41:
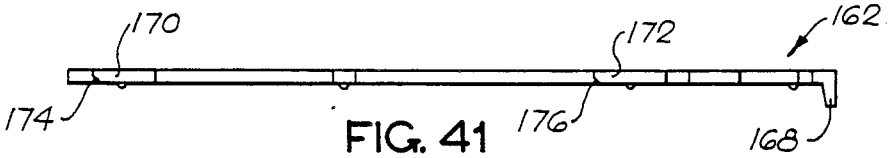
FIG. 41 is a top plan view of the delatch bar for the control device.

As shown in FIGS. 29 and 30, the ramp 174 on the first operating tab 170 is engageable by the first sloping ramp or cam 126 on the first or OFF push button 18*a*. The sloping ramp 176 on the second operating tab 172 is positioned for engagement by the first ramp or cam 126 on the sixth or DEFROST push button 18*f*. In each case, the sloping ramp or cam 126 is sufficiently long to engage and operate both the first latching bar 110 and the delatching bar 162. The latching teeth 124, including the cams 126, are afforded access to the first and second latching bars 110 and 140, and also to the delatching bar 162, through nine variously shaped openings 178 in a horizontal upper wall member 180 of the port plate member 42, as shown in FIG. 9, and also in FIGS. 29 and 30.

The first or OFF push button 18*a* is shown in its extended position in FIG. 29, and in its depressed position in FIG. 30. When the push button 18*a* is depressed, its first cam 126 engages the ramp or follower 174 on the first operating tab 170, whereby the delatching bar 162 is moved to the right, when viewed from above, as in FIGS. 29 and 30, or to the left, when viewed from below, as in FIGS. 45 and 46. The movement of the delatching bar 162 causes the tab 168 thereon to push the second latching bar 140 to its unlatched or disabled position, as previously described, with reference to FIG. 46.

The same operation of the delatching bar 162 is produced by depression of the DEFROST push button 18*f*, in that its first cam 126 engages the ramp or follower 176 on the second operating tab 172, whereby the delatching bar 162 is moved to the right, when viewed from above, as in FIGS. 29 and 30. Thus, depressing either the OFF push button 18*a* or the DEFROST push button 18*f* operates the delatching bar 162 and causes delatching of the eighth and ninth push buttons 18*h* and 18*i*, which are adapted to be latched by the second latching bar 140. It will be recalled that the OFF and DEFROST push buttons 18*a* and 18*f* are members of the first group of push buttons 18*a*–18*f*, all of which are adapted to be individually latched by the first latching bar 110. The depression of either the OFF push button 18*a* or the DEFROST push button 18*f* causes all of the other push buttons in the first group to be unlatched, as previously described.

As previously indicated, the A/C push button 18*g* has a pushpush latching action, whereby the push button 18*g* is latched in its depressed position, by a first push, and is unlatched to its extended position, by a second push. The push-push latching action is produced by the push-push latching mechanism 102, illustrated in FIGS. 25, 26, 49–54, 55–62, and 90–92. The push-push latching mechanism 102 comprises a swingable latching hook 184, pivotally mounted on the carriage 40 of the A/C push button 18*g*; a biasing spring 186 (FIGS. 59 and 60) for the swingable latching hook 184; a stationary latching pin 188, mounted on the port plate member 42 and projecting upwardly for cooperative engagement with the latching hook 184; and a cam tab 190 (FIGS. 49–52), projecting upwardly from the port plate member 42, near the latching pin 188, for cooperation with the latching hook 184. The cam tab 190, illustrated as being molded in one piece with the port plate member 42, projects upwardly through an opening 192 of irregular shape in the carriage 40 on the shaft 34 of the A/C push button 18*g*. As previously indicated, the push button shafts 34 for all of the push buttons 18*a*–18*i* are the same in construction.

As shown in FIGS. 49–53, the latching hook 184 has a pivot opening 193 which is pivotally received on an upwardly projecting stub shaft 194, illustrated as being molded in one piece with the carriage 40 of the A/C push button 18*g*. The biasing spring 186 is operative to bias the latching hook 184 downwardly into slidable engagement with an upwardly facing surface 196 on the carriage 40, while also swingably biasing the latching hook 184 in a counterclockwise direction, or to the left, when viewed from above, as in FIGS. 49–52.

Figure 59:
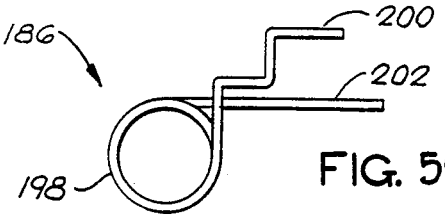
FIG. 59 is a greatly enlarged top view of the biasing spring for the latch hook.
Figure 60:
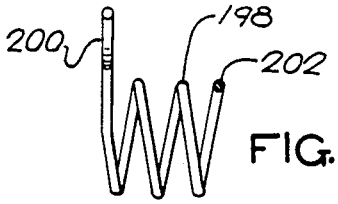
FIG. 60 is a fragmentary side view of the biasing spring of FIG. 59.
Figure 55:
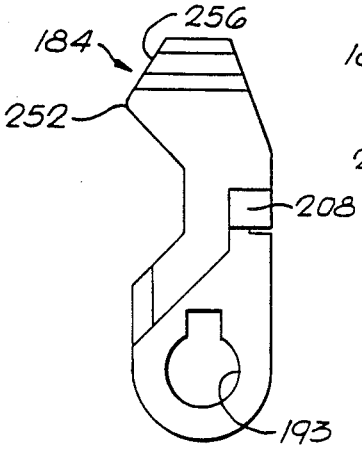
FIG. 55 is a greatly enlarged top view of the push-push latch hook.
Figure 57:
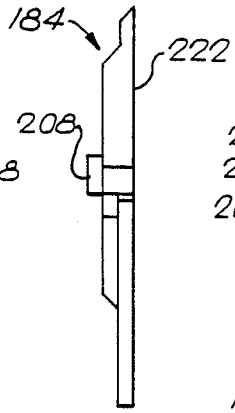
FIG. 57 is a greatly enlarged side view of the latch hook.
Figure 56:
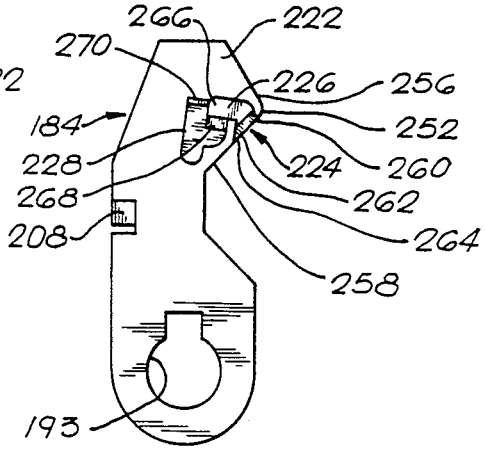
FIG. 56 is a greatly enlarged bottom view of the latch hook.
Figure 58:
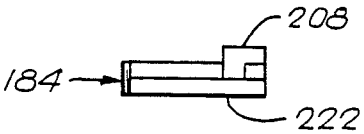
FIG. 58 is a greatly enlarged end view of the latch hook.
Figure 62:
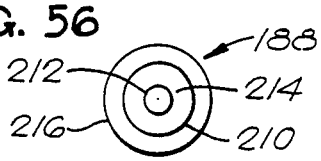
FIG. 62 is a greatly enlarged top end view of the latch pin.

The biasing spring 186, as shown separately in FIGS. 59 and 60, is made of spring wire and comprises a coiled portion 198, an upper end portion or arm 200, and a lower end portion or arm 202. The coiled portion 198 is received around the stub shaft 194 and is retained in a compressed position under a key tab 204, projecting rearwardly from the upper end portion of the shaft 194. The upper end portion or arm 200 of the spring 186 is retained on the left hand side of an upwardly projecting ear or tab 206 on the push button shaft 34 of the push button 18*g*. When the spring 186 is being installed, the lower end portion or arm is swung clockwise, against the biasing force of the spring, and is hooked on the right hand side of a spring retaining ear 208, projecting upwardly and laterally from the upper side of the latching hook 184, whereby the spring swingably biases the latching hook in a counterclockwise direction. When the A/C push button 18*g* is in its initial extended position, as shown in FIGS. 49 and 50, the latching hook 184 engages the diamond shaped cam tab 190 and is in its unlatched condition. When the push button 18*g* is pushed inwardly for the first time, the latching hook 184 becomes latched by the latching pin 188, in a manner to be described in greater detail presently. When the push button 18*g* is pushed a second time, the latching hook is caused to escape from the latching pin 188, so that the push button 18*g* returns outwardly to its extended position, due to the force of its return spring 44, when the push button is allowed to return outwardly by the release of the second push.

Figure 61:
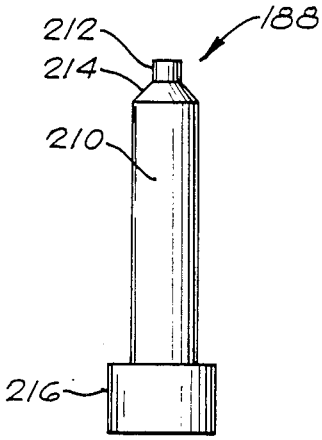
FIG. 61 is a greatly enlarged elevational view of the latch pin.

The latching pin 188 is illustrated as being made of metal, for maximum strength and durability, but could possibly be made of resinous plastic or some other suitable material As illustrated separately in FIG. 61, the latching pin 188 has a generally cylindrical body portion 210, a reduced cylindrical tip portion 212 of greatly reduced diameter, at the upper end of the pin 188, a tapered frustoconical portion 214 between the body portion and the tip portion, and an enlarged head 216 at the lower end of the pin 188. The reduced tip portion 212 of the pin 188 is actually involved in the latching engagement with the push-push latching hook 184.

The latching pin 188 is mounted in a fixed position on the port plate member 42, in that the body portion 210 of the pin 188 extends upwardly through a locating hole or bore 218 in the port plate member 42, as shown in FIG. 47, which shows the pin 188 in an inverted position. The enlarged head 216 of the pin 188 is flush with the lowermost surfaces 220 of the port plate member 42, and is retained in its operative position by the lower cover member 114 of the housing 12 for the control device 10. The reduced tip portion 212 and the tapered portion 214 of the pin 188 project upwardly above the port plate member 42 and through the opening 192 in the carriage 40 of the push button 18*g*, for latching engagement of the tip portion 212 with the push-push latching hook 184.

Figure 92:
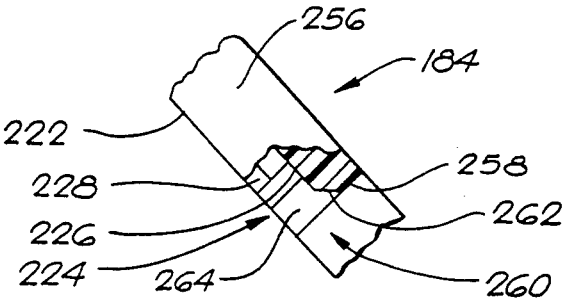
FIG. 92 is a fragmentary auxiliary view, partly in section and taken generally along the broken line 92—92 in FIG. 90.
Figure 90:
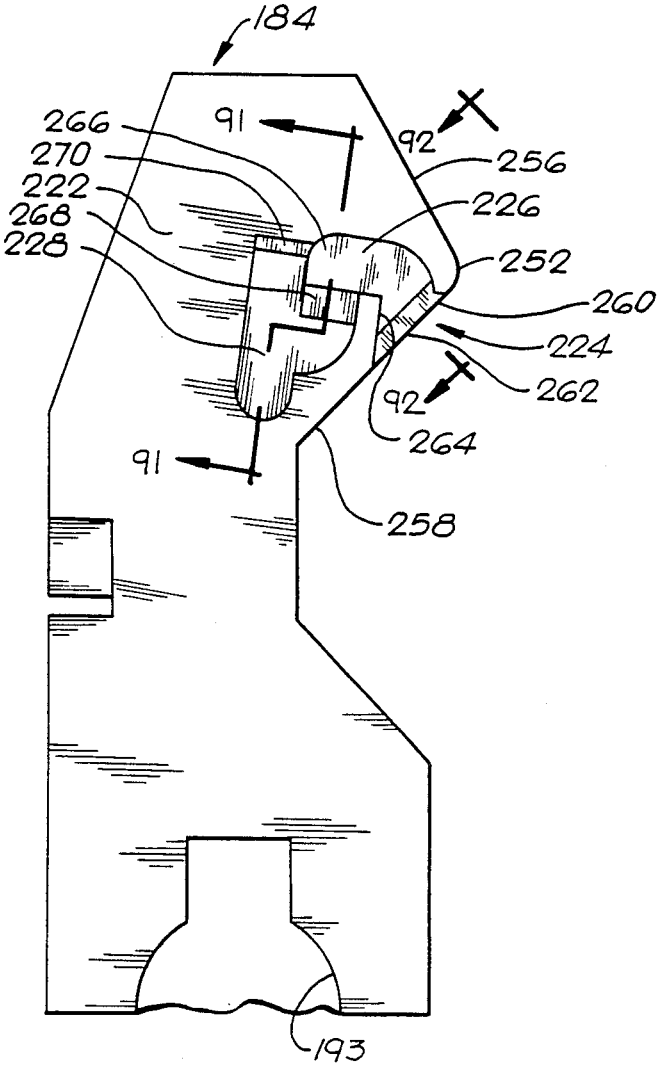
FIG. 90 is a fragmentary diagrammatic view, similar to a portion of FIG. 54, but greatly enlarged, showing a portion of the underside of the push-push latching hook.
Figure 91:
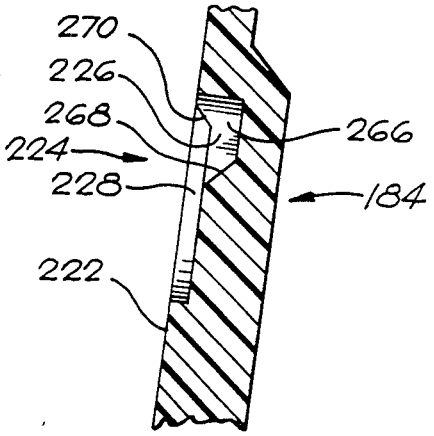
FIG. 91 is a fragmentary enlarged section, taken generally along the broken line 91—91 in FIG. 90.

As shown separately in FIGS. 90–92, the latching hook 184 has a smooth generally horizontal lower surface 222, formed with a complex latching track or channel 224, for push-push latching engagement with the tip portion 212 of the latching pin 188.

When the A/C push button is pushed for the first time, the movement of the latching hook 184 is such that a deeper portion 226 of the latching track 224 becomes latched on the tip portion 212 of the latching pin 188. When the push button 18*g* is pushed for a second time, the movement of the hook 184 is such that the hook uses a shallower portion 228 of the latching track 224 to escape from the tip portion 212 of the latching pin 188, so that the hook 184 is unlatched.

The push-push latching hook 184 is adapted to be delatched by the operation of the delatching mechanism 108, whereby the delatching bar 162 is moved, as previously described, by the depression of either the OFF push button 18*a* or the DEFROST push button 18*f*.

Figure 42:
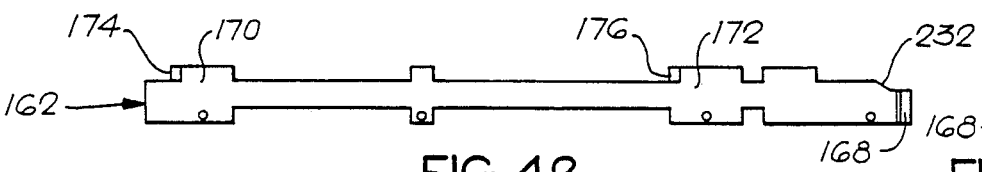
FIG. 42 is a front elevation of the delatch bar.
Figure 43:
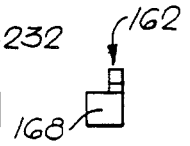
FIG. 43 is a right end view of the delatch bar.
Figure 44:
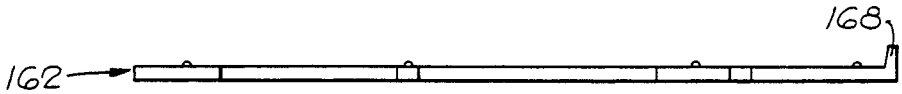
FIG. 44 is a bottom view of the delatch bar.

The delatching of the latching hook 184 is brought about by a vertically movable delatching pin 230 (FIGS. 47, 63–65) which is adapted to be moved upwardly under the latching hook 184 by a cam or ramp 232, formed on the upper side of the delatching bar 162 near its right hand end, when viewed from the front, as in FIG. 42. Thus, the operating movement of the delatching bar 162 to the right causes the cam 232 to displace the delatching pin 230 upwardly, so that it pushes the latching hook 184 upwardly to a disabled or inoperative position, as shown in FIG. 53, in which the latching hook 184 is tilted upwardly against the biasing action of the spring 186, whereby the hook 184 is out of engagement with the tip portion 212 of the latching pin 188. By this operation, the hook 184 is delatched, if it was previously latched, and is rendered incapable of latching with the tip portion 212 of the latching pin 188.

Figure 65:
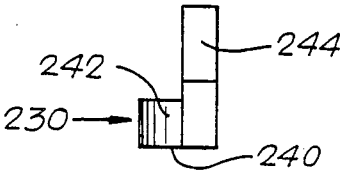
FIG. 65 is a greatly enlarged bottom view of the delatch pin.
Figure 64:
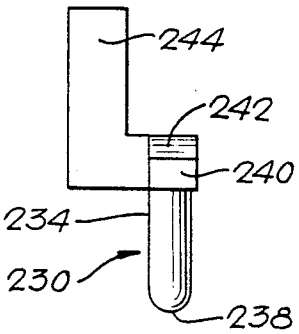
FIG. 64 is a greatly enlarged inverted side elevation of the delatch pin.
Figure 63:
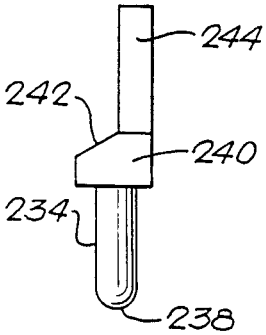
FIG. 63 is a greatly enlarged inverted front elevation of the delatch pin.

The delatching pin 230, shown separately in FIGS. 63–65, has a cylindrical pin portion 234 which is slidable vertically through a hole or bore 236, formed in the port plate member 42. The hole 236 extends upwardly from the channel 164 for the delatching bar 162, near the right hand end of the channel, when the port plate member 42 is viewed from above. The hole 236 is positioned so as to be located under the latching hook 184 on the A/C push button 18*g*. The cylindrical pin portion 234 has a rounded tip 238, normally directed upwardly, and an enlarged head 240, normally directed downwardly. The head 240 has a downwardly facing cam follower ramp 242 thereon, for engagement by the operating cam or ramp 232 on the delatching bar 162. A generally L-shaped tab 244 extends laterally and downwardly from the enlarged head 240 and is adapted to extend forwardly through the opening 160 and into the adjacent end of the channel 142 for the second latching bar 140, as shown in FIGS. 45 and 46. The L-shaped tab 244 stabilizes the position of the delatching pin 230 and also serves as a handle, whereby the pin may be inserted easily into the hole 236.

Initially, when the delatching bar 162 is in its unactuated position, as shown from below in FIG. 45, it is pushed to the right by the biasing spring 146 for the second latching bar 140, thus allowing the cylindrical pin portion 234 of the delatching pin 230 to be pushed downwardly by the latching hook 184, which is biased downwardly by its biasing spring 186. When thus moved downwardly, the delatching pin 230 is ineffective to affect the push-push latching action of the latching hook 184. When either the OFF push button 18*a* or the DEFROST push button 18*f* is depressed, the delatching bar 162 is moved to the left, when viewed from below, as in FIG. 46, whereupon the cam or ramp 232 on the delatching bar 162 pushes the delatching pin 230 upwardly so that the latching hook 184 is tilted upwardly into its disabled or delatched position, as previously described in connection with FIG. 53. Thus, the A/C push button 18*g* is delatched, if previously latched, and is rendered incapable of being latched, until the delatching bar 162 is deactuated by depression of one of the push buttons 18*b*–18*e*.

Figure 86:
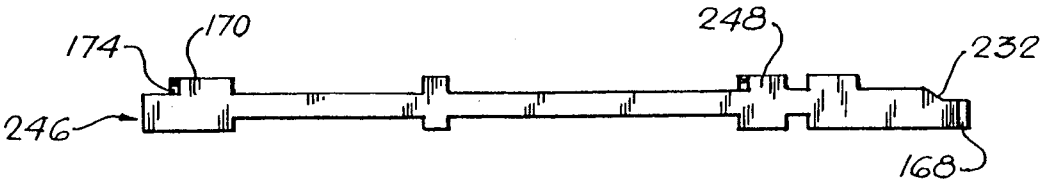
FIG. 86 is a front elevation, somewhat similar to FIG. 42, showing a modified delatch bar which is operable by the OFF push button only.

FIG. 86 illustrates a modified delatching bar 246, adapted to serve as a direct replacement for the previously described delatching bar 162, but differing from the delatching bar 162, in that the modified delatching bar 246 is adapted to be operated by the OFF push button 18*a* only, and not by the DEFROST push button 18*f*. This change in operation is achieved by replacing the second operating tab 172 with a shortened tab 248 which, in effect, is only a dummy tab, not having sufficient width to be operated by the first ramp or cam 126 on the latching tooth 124 of the DEFROST push button shaft 34. Otherwise, the delatching bar 246 of FIG. 86 is the same as the delatching bar 162 of FIG. 42, in that the modified delatching bar 246 includes the forwardly projecting tab 168, the first operating tab 170, and the delatching cam or ramp 232.

As shown in FIGS. 45 and 46, the second lockout mechanism 106 comprises a single additional lockout block 132, of the construction already described, slidably received in a relatively short transverse channel 250 which is longer than the single lockout block 132 by an amount slightly greater than the width of one of the lockout penetrating members or blades 136. The eighth and ninth slots 138 for the eighth and ninth push buttons 18*h* and 18*i* are located opposite the ends of the transverse channel 250. Because of this construction, only one of the push buttons 18*h* and 18*i* can be depressed at any one time.

Figure 67:
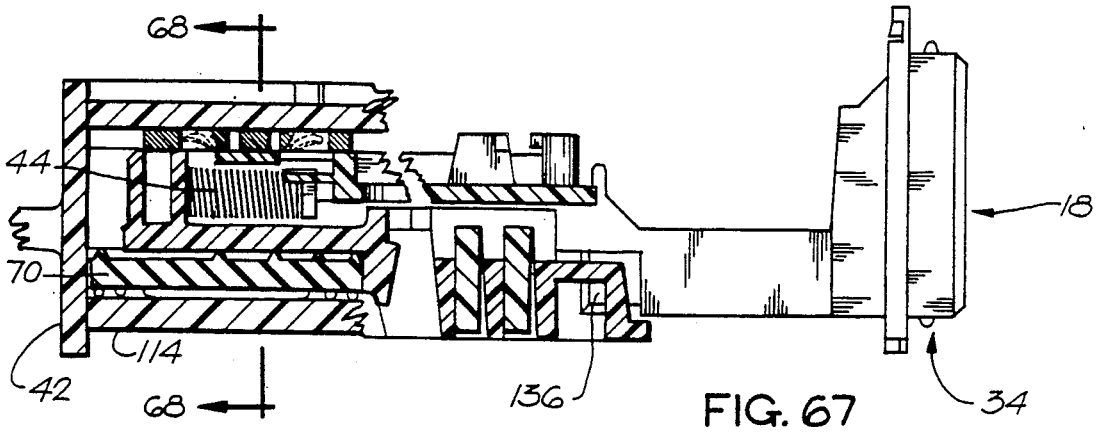
FIG. 67 is a fragmentary enlarged section, somewhat similar to FIG. 66, but taken through the offset mounting structure for the return spring.
Figure 68:
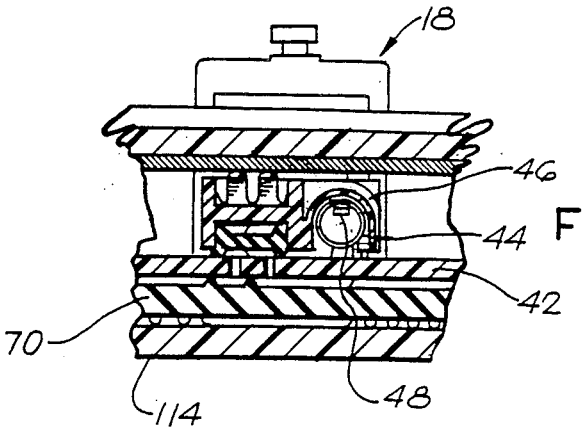
FIG. 68 is a fragmentary vertical cross section, taken generally along the line 68—68 in FIG. 67.

As shown in FIGS. 67 and 68, each coil spring 44, acting as a return spring for the corresponding push button 18, is confined between the corresponding semicylindrical nest member 46 and the port plate member 42. Due to the semicylindrical shape of the nest member 46, it has an open side which faces toward the port plate member 42. The natural tendency of the long compression coil spring 44 to exhibit lateral instability is controlled by the confinement afforded by the port plate 42 and the semicylindrical nest member 46.

The push-push latching mechanism 102 for the A/C push button 18*g* is shown in FIGS. 49–54. Moreover, the latching hook 184 is shown in FIGS. 55–58 and 90–92. In FIGS. 49 and 50, the latching hook 184 is shown in its initial, unlatched position, which it occupies when the push button 18*g* is fully extended. The latching hook 184 has a rounded laterally projecting nose 252, extending to the left when viewed from above, as in FIGS. 49–52 and 55. In the unlatched position of FIGS. 49 and 50, the nose 252 is pressed against a first surface 254 of the diamond shaped cam tab 190, by the biasing action of the spring 186. The nose 252 is at the junction between first and second oppositely diagonal cam edges 256 and 258 on the left hand edge portion of the latching hook 184, when viewed from above. In the initial, unlatched position of FIGS. 49 and 50, the first diagonal cam edge 256 is near the latching pin 188, but spaced forwardly therefrom.

When the push button 18*g* is first depressed, the first diagonal cam edge 256 engages the reduced tip portion 212 of the latching pin 188. Further depression of the push button 18*g* causes the cam edge 256 to ride along the tip portion 212, so that the latching hook 184 is swung clockwise, against the force of the spring 186, until the nose 252 of the latching hook 184 engages the tip portion 212, as shown in FIG. 51. The second diagonal cam edge 258 then rides along the tip portion 212, until the entrance 260 of the latching track 224 is moved opposite the tip portion 212. At the entrance 260, the track 224 is formed with an entrance ramp 262, which facilitates the entry of the tip portion 212 into the entrance 260. The entrance ramp 262 slides along the tip portion 212 until a wall 264 engages the tip portion 212. During this stage, the latching hook 184 is swung counterclockwise a short distance by the biasing spring 186. The wall 264 extends generally parallel with the radial length dimension of the hook 184. At this time, the push button 18*g* is fully depressed during its first push.

When the push button 18*g* is released slightly, it moves forwardly, so that the tip portion 212 of the pin 188 clears the wall 264, whereupon the hook 184 is swung by an additional amount in a counterclockwise direction, while the deeper portion 226 of the track 224 slides along the tip portion 212, until the tip portion is engaged by a latching corner or terminus 266 of the deeper track portion 226. This is the latched position of the hook 184. In FIG. 54, the tip portion 212 is shown as a full line circle, hatched for metal, in the latching corner 266. FIG. 52 represents the fully latched position of the latching hook 184.

When the push button 18*g* is pushed and fully depressed for a second time, the tip portion 212 of the latching pin 188 is engaged by a second ramp 268, enabling the tip portion 212 to escape into the shallower portion 228 of the track 224. Meanwhile, the latching hook 184 is swung counterclockwise an additional amount by the biasing spring 186. The counterclockwise movement of the hook 184 also causes the second diagonal cam edge 258 of the hook 184 to engage a diagonal cam surface 269 on the stationary cam tab 190. The hook 184 is now unlatched, but the push button 18*g* is still fully depressed.

When the push button 18*g* is allowed to slide outwardly, by the release of the second push, the shallower track portion 228 travels along the tip portion 212, until the tip portion is encountered by a third ramp 270. After the third ramp 270 passes the tip portion 212, it comes into engagement with the smooth lower surface 222 of the latching hook 184, at which time the tip portion 212 has fully escaped from the latching track 224. While this is going on, the engagement between the second diagonal cam edge 258 of the hook 184 and the diagonal cam surface 269 of the stationary cam tab 190 causes the latching hook 184 to be swung clockwise, against the force of the biasing spring 186. In this way, the latching hook 184 is swung out of engagement with the tip portion 212. The nose 252 on the hook 184 slides along the diagonal cam surface 269 and returns to its original unlatched position, engaging the first surface 254 of the cam tab 190. This completes the push-push latching and unlatching cycle of the latching hook 184.

Figure 14:
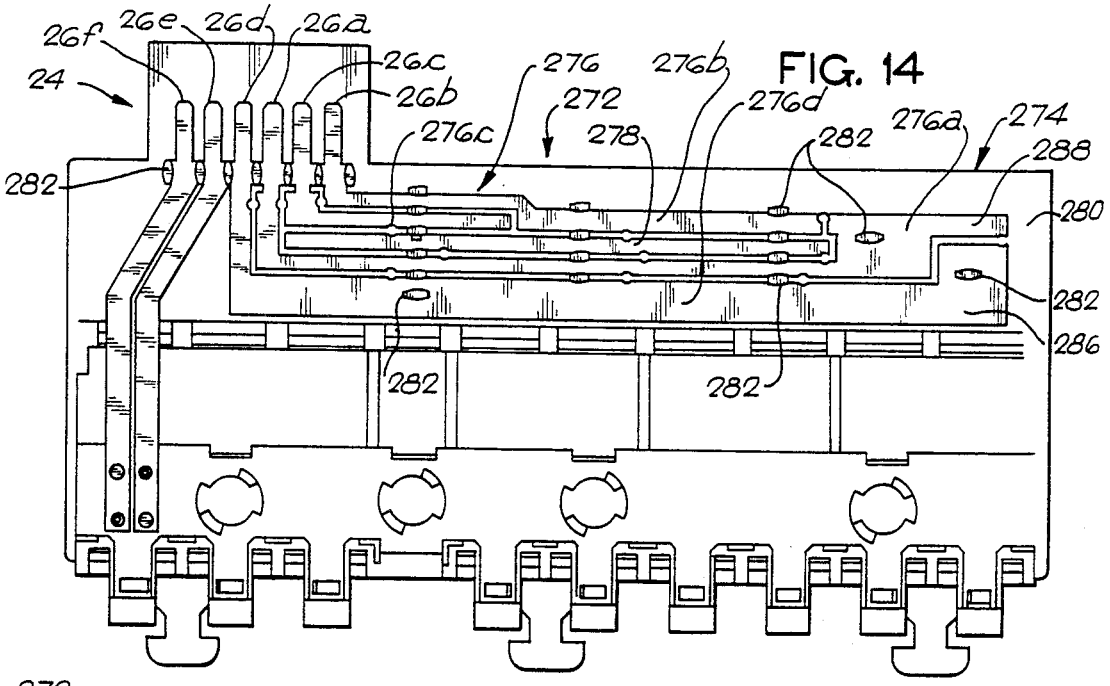
FIG. 14 is a bottom plan view of a terminal head assembly comprising stationary contact means and the associated electrically insulating support, forming the top cover for the housing of the control device.
Figure 15:
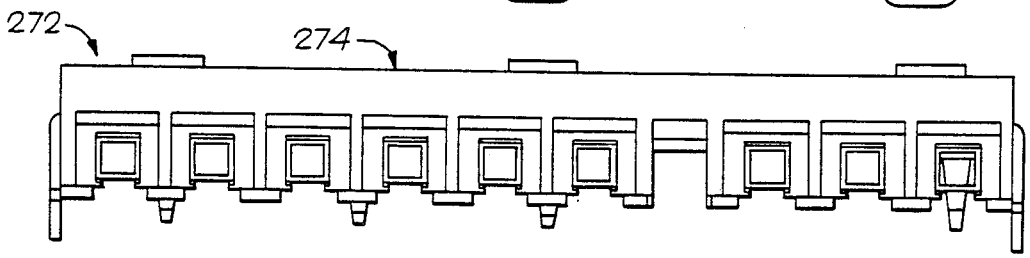
FIG. 15 is a front elevation of the terminal head assembly of FIG. 14.
Figure 16:
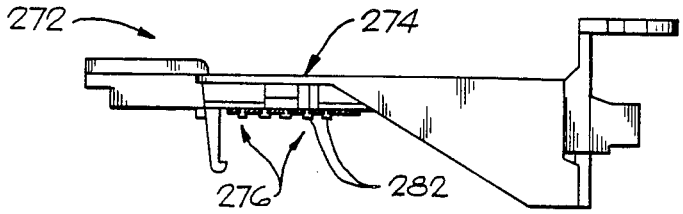
FIG. 16 is a left side elevation of the terminal head assembly of FIG. 14.

FIG. 14 illustrates the electrical terminal assembly 24 comprising the six electrical terminals 26*a*–26*f*, as previously described. The electrical terminals 26*a*–26*f* are components of a terminal head 272, which is an assembly of electrically conductive components mounted on an electrically insulating terminal head plate 274, preferably molded in one piece from a suitable resinous plastic material. The terminal head 272 serves as the upper cover of the housing 12 for the control device.

The electrical terminals 26*a*–26*f* are also shown in the schematic circuit diagram of FIG. 69, as previously described. The electrical terminals 26*a*–26*d* are involved in the electrical switching functions, carried out by the push buttons 18 of the control device 10.

As shown in FIG. 14, the first four electrical terminals 26*a*–26*d* are connected to fixed contact means 276, mounted on the insulating plate 274, and illustrated as comprising electrically conductive metal contact bars or strips 276*a* ∝ 276*d*, formed in one piece with the electrical terminals 26*a*–26*d*, respectively.

The insulating terminal head plate 274 of FIG. 14 also supports a dummy bar 278, to which no electrical connection is made. The dummy bar 278 serves a purely mechanical function, to assist in the sliding movement of some of the spring contactors 56, as will be described in greater detail presently. All of the contact bars 276*a*–276*d* and the dummy bar 278 are mounted against a smooth lower surface 280 of the insulating plate 274 and are suitably secured to the plate 274. Various securing means may be employed, which are illustrated as quite a number of resinous plastic ribs 282 which are molded in one piece with the resinous plastic plate 274. The ribs 282 project downwardly a short distance below the smooth lower surface 280 of the plate 274 and are disposed in various locations, between and alongside the bars 276*a*–276*d* and 278, and also through certain corresponding openings in the bars 276*a* and 276*d*. The lower extremities of the ribs 282 are flattened or staked to produce enlarged heads which overlap the edges of the bars 276*a*–276*d* and 278.

Figure 25:
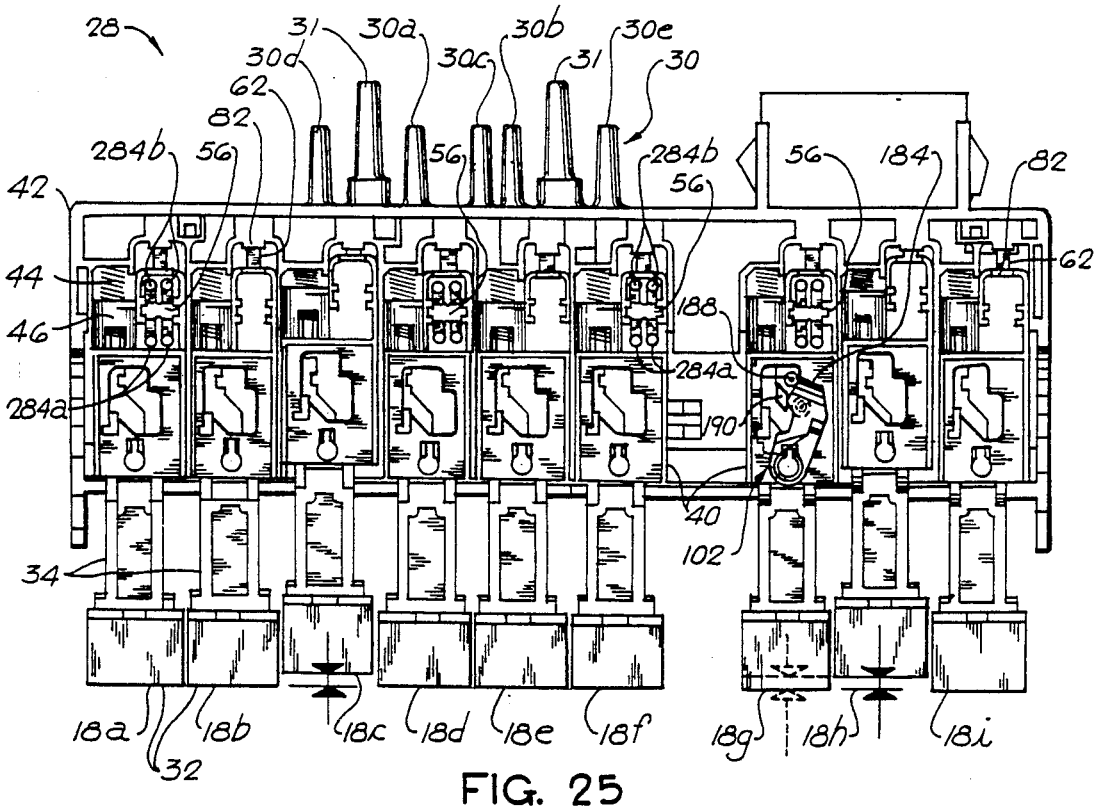
FIG. 25 is a top plan view showing a partial assembly, in which the push button assemblies are shown in their assembled relation on the port plate, the third and the eighth push buttons being shown in their depressed and latched positions.
Figure 26:
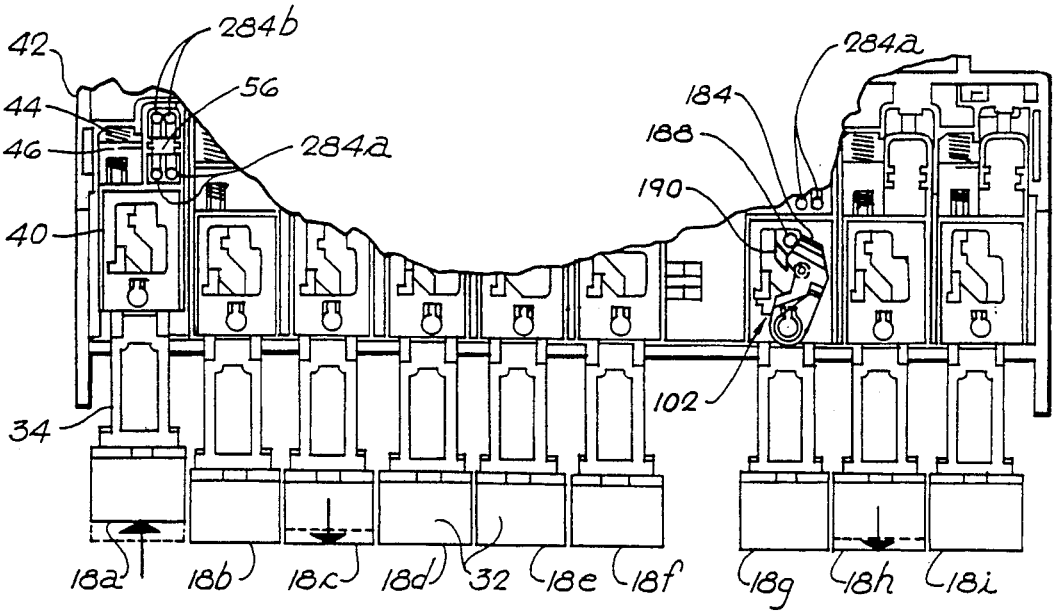
FIG. 26 is a fragmentary top plan assembly view, similar to a portion of FIG. 25, but showing the first or OFF push button in its depressed and latched position, while all of the other push buttons are shown in their extended and unlatched positions.

As previously indicated, the electrical contactors 56 are provided on at least some of the push buttons 18*a*–18*i*. The exact number and arrangement of the contactors 56 is subject to variation, in accordance with the switching functions to be accomplished. In the present construction, as illustrated in FIG. 25, only the OFF push button 18*a*, the FLOOR push button 18*d*, the DEFROST push button 18*f*, and the A/C push button 18*g* are provided with respective contactors 56 because these four push buttons are the only push buttons to which switching functions are assigned.

Figure 66:
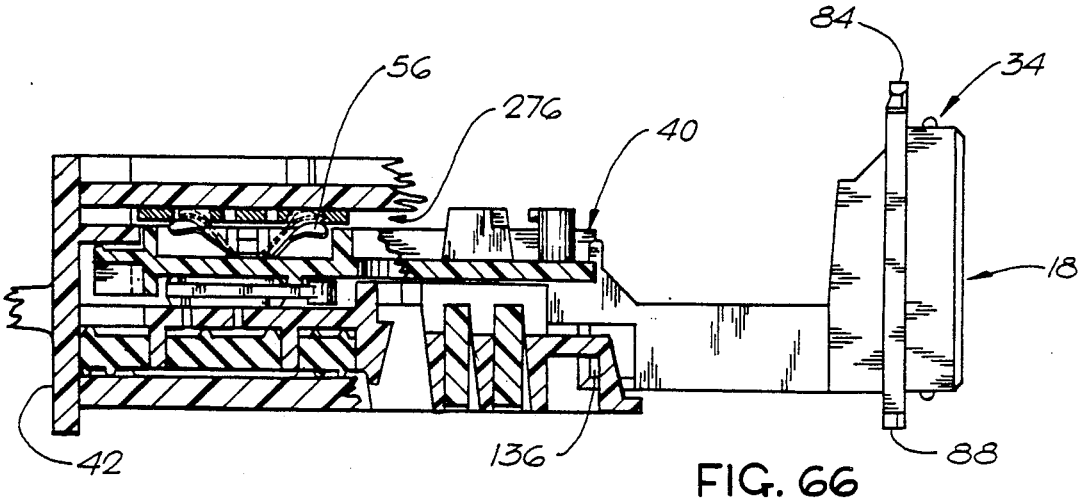
FIG. 66 is an enlarged fragmentary section taken longitudinally through one of the push buttons, assembled with the port plate, the view being taken through the contactor, the guiding tongue, and the lower portion of the carriage which supports the valve member.

The construction of the electrical contactors 56 is illustrated separately in FIGS. 77–79. As previously indicated, each contactor 56 is generally in the form of a leaf spring. All of the contactors 56 are the same. One of the contactors 56 may be mounted on the carriage 40 of any desired push button 18. Each contactor 56 is made of a suitable electrically conductive spring metal. It will be seen from FIGS. 77 and 78 that each contactor 56 has two pairs of oppositely projecting spring fingers 284*a* and 284*b*. Purely for the sake of convenience, the spring fingers will be referred to as the forwardly projecting spring fingers 284*a* and the rearwardly projecting spring fingers 284*b*. It will be understood that the terms forwardly and rearwardly are relative, and that the positions of the contactors 56 can be reversed, as desired. The ends of the spring fingers 284*a* and 284*b* are smoothly rounded, in the manner of contact points, so that the spring fingers will slide smoothly along the fixed contact means 276. When each of the contactors 56 is in its position of use, the contactor 56 is compressed between the corresponding push button carriage 40 and the fixed contact means 276, as shown in FIG. 66. In this way, contact pressure is developed between the contactor 56 and the fixed contact means 276.

It will be understood that the terminal head assembly 272 of FIG. 14 is viewed from below, so that the view is reversed from right to left, with respect to FIG. 25, in which the push buttons 18*a*–18*i* are viewed from above. When the OFF push button 18*a* is in its extended position, both sets of contactor spring fingers 284*a* and 284*b* engage a right hand portion 286 of the fixed contact bar 276*d*. When the push button 18*a* is depressed, the rear spring fingers 284*b* engage a right hand portion 288 of the fixed contact bar 276*a*, thus closing an electrical circuit between the bars 276*d* and 276*a*.

In both the extended and depressed positions of the FLOOR push button 18*d*, the forwardly projecting spring fingers 284*a* of the corresponding contactor 56 engage the contact bar 276*d*. When the push button 18*d* is extended, the rearwardly projecting spring fingers 284*b* engage the dummy contact bar 278. When the push button 18*d* is depressed, the rearwardly projecting spring fingers 284*b* of the corresponding contactor 56 are slidable into engagement with the contact bar 276*b*, so that a circuit is closed between the bars 276*b* and 276*d*.

In both the extended and depressed positions of the DEFROST push button 18*f*, the forwardly projecting spring fingers 284*a* of the corresponding contactor 56 are slidable along the contact bar 276*d*. When the push button 18*f* is extended, the rearwardly projecting spring fingers 284*b* engage the dummy contact bar 278. When the push button 18*f* is depressed, the rearwardly projecting spring fingers 284*b* of the corresponding contactor 56 are slidable into engagement with the contact bar 276*c*, so as to close a circuit between the bars 276*c* and 276*d*. This circuit closure energizes the air conditioning.

In both the extended and depressed positions of the A/C push button 18*g*, the forwardly projecting spring fingers 284*a* of the corresponding contactor 56 are slidable along the contact bar 276*d*. When the push button 18*g* is extended, the rearwardly projecting spring fingers 284*b* engage the dummy contact bar 278. When the push button 18*g* is depressed, the rearwardly projecting spring fingers 284*b* of the corresponding contactor 56 are slidable into engagement with the contact bar 276*c*, which energizes the air conditioning, as previously described. Thus, depression of either of the push buttons 18*f* and 18*g* energizes the air conditioning.

The construction of the valve members 60 is illustrated separately in FIGS. 72–76. In this case, all of the valve members 60 are the same in construction, for ease of assembly, but the construction could be varied. However, the arrangements of the ports 68 for the various push buttons 18 are different, as will be seen from FIGS. 9 and 11, so that the valving functions of the push buttons 18 can be different. FIG. 72 shows the bottom or operative side of the valve member 60, which is illustrated as having a system of downwardly projecting ridges or fins 290 which are in slidable sealing engagement with the smooth upper surfaces 66 of the port plate 42. As illustrated, the ridges 290 form the boundaries of three closed valving channels or passages 292, 294 and 296 having different configurations, which may be described as long, short, and L-shaped, respectively. Generally, the short channel 294 may be employed to block one of the valve ports 68, while the long and L-shaped channels 292 and 296 may be employed to connect different ports together, in certain positions of the valve member 60.

FIG. 74 shows the upper or passive side of the valve member 60, having a pattern of upwardly projecting ridges or fins 298 forming a mirror image of the pattern established by the valving ridges 290. The upper ridges 298 provide a soft resilient spring action for the valving ridges 290, as disclosed and claimed in the Halstead and Black U.S. Pat. No. 4,448,390, patented May 15, 1984.

The forwardly projecting extension or tab 79, previously described, is connected to the valve member 60 by a neck or web member 300, in which a non-symmetrical keyway opening 302 is formed. When each valve member 60 is mounted on the corresponding push button carriage 40, the non-symmetrical keyway opening 302 receives a correspondingly shaped locating key or lug member 304, to insure that the valve member 60 is assembled in the proper orientation on the carriage member 40, and is not assembled upsidedown (FIGS. 21, 72 and 74).

As previously described, the valve ports 68 are provided for seven of the nine valve members 60, which may be characterized as functional. The other two valve members 60 are not assigned any valving functions and are provided so that all of the nine push buttons will have the same operating feel. The valve ports 68 are provided in various arrangements for the seven functional valve members 60, which are mounted on the seven push buttons 18*a*–18*f* and 18*h* to which valve functions are assigned. When each of these push buttons is depressed or extended, the corresponding valve member 60 changes the connections between the corresponding valve ports 68.

Figure 11:
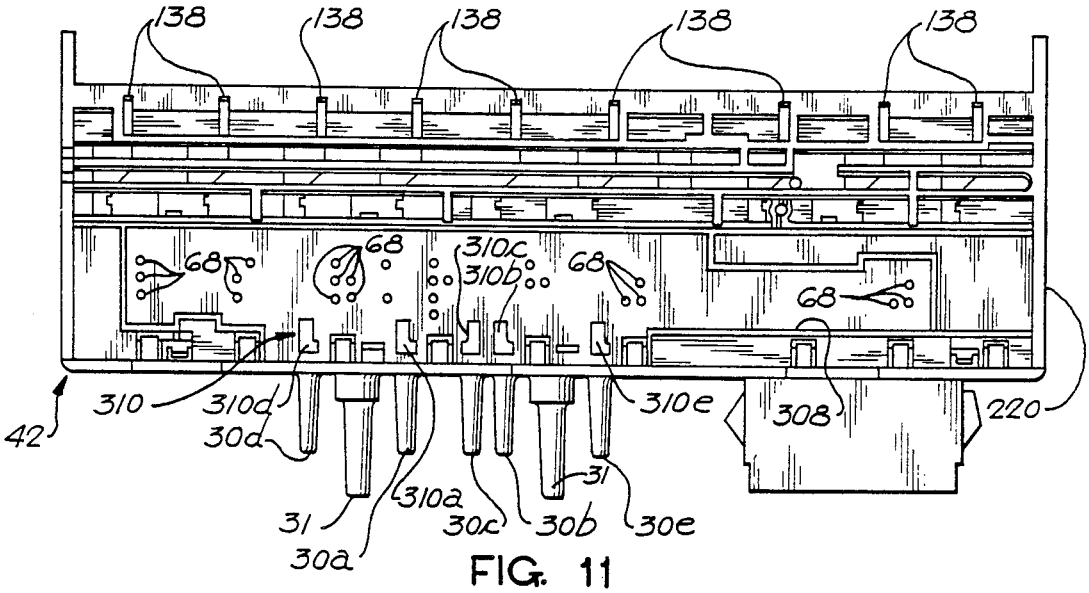
FIG. 11 is a bottom plan view of the port plate.
Figure 12:
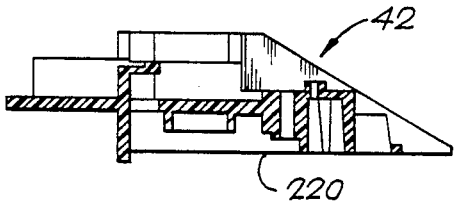
FIGS. 12 and 13 are vertical sections taken through the port plate, generally along the lines 12—12 and 13—13 in FIG. 9.
Figure 13:
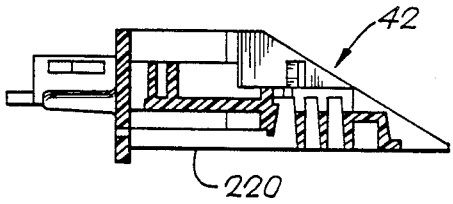

As previously described, the valve ports 68 extend downwardly from the smooth valve surfaces 66 on the upper side of the port plate member 42, as shown in FIG. 9. As shown in FIG. 11, the ports 68 emerge from a smooth surface 306 on the lower side of the port plate member 42. The rubber vacuum distribution manifold 70 is mounted against the smooth surface 306 and is contained in a recess or nest 308, formed on the lower side of the port plate member 42, as shown in FIG. 45, in which the manifold 70 is shown in phantom.

The rubber vacuum distribution manifold 70 is an important component of a vacuum distribution system or means for establishing a program of fluid connections between the valve ports 68 and the terminal ports or nipple 30*a*–30*e*, whereby vacuum is supplied from and delivered to a vacuum connector, not shown, leading to a vacuum source and various vacuum operated motors in the air control system. The terminal port or nipples 30*a*–30*e* are shown in FIGS. 2, 11 and 45.

As shown in FIGS. 11 and 45, in which the port plate member 42 is viewed from below, the port plate member 42 is formed with an array of five passages 310, identified individually as 310*a*, 310*b*, 310*c*, 310*d* and 310*e*, which emerge from the smooth lower surface 306 of the recess 308 and connect with the corresponding nipple-shaped terminal ports 30*a*–30*e*, respectively. Hollows are molded into the port plate member 42 between the respective terminal ports 30*a*–30*e* and the corresponding passages 310*a*–310*e*.

As shown in FIG. 45, the vacuum distribution manifold 70 covers the ports 68 and the terminal passages 310*a*–310*e* and forms a vacuum distribution system therebetween, in accordance with a program determined by the construction and layout of the manifold 70.

As shown in FIG. 70, the manifold 70 has an upper side 312 which is provided with a system or maze of vacuum distribution passages 314, bounded by a system or array of ridges or fins 316, projecting upwardly from the upper side 312 and pressed into sealing engagement with the smooth lower surface 306 of the port plate member 42. The manifold 70 is pressed against the surface 306 by the lower cover member 114 of the housing 12. The passages 314 and the ridges 316 on the manifold 70 are arranged in accordance with a program, whereby the passages 314 communicate with the valve ports 68, and also with the five terminal passages 310*a*–310*e*, leading to the nipple-shaped terminal ports 30*a*–30*e*. The passages 314 afford the desired distribution of vacuum, to and from the valve ports 68, so that the valve members 60 on the push button carriages 40 can accomplish the desired program of valving functions. A variety of programs can be employed by varying the arrangement of the vacuum distribution passages 314. If a modified valving program is desired, a modified manifold can be constructed and installed, as a direct substitution for the manifold 70.

As shown in FIG. 71, a multiplicity of small bosses 318 project downwardly from lower side of the manifold 70 to afford springiness or resilience, whereby the ridges 316 on the upper side 312 of the manifold 70 are uniformly pressed into sealing engagement with the smooth lower surface 306 of the port plate member 42, when the manifold 70 is compressed between the port plate 42 and the lower cover 114 of the housing 12.

We claim:

1. A vacuum control device for automotive air control systems, said device comprising a stationary housing, a push button array including a plurality of push buttons for accomplishing various vacuum valving functions, guiding means in said housing for guiding each of said push buttons for sliding movement in a predetermined direction between forwardly extended and rearwardly depressed positions, a plurality of springs disposed between the housing and the respective push buttons for biasing the respective push buttons toward their forwardly extended positions, said push buttons including respective carriages fixed thereon for sliding movement therewith and having respective soft resilient compressible rubber-like valve members fixedly mounted on the respective carriages for sliding movement therewith and facing transversely relative to the predetermined direction of sliding movement, a stationary port member mounted fixedly in said housing and slidably engageable by said valve members and having port means traversed by at least certain of the valve members for accomplishing at least one vacuum valving function in response to movement of the push buttons between extended and depressed positions, said valve members having valve passage means therein for selectively cooperating with said port means to accomplish the vacuum valving function, and additional guiding means including tongue and slot guiding elements connected between the respective carriages and said port member for guidingly confining the carriages in a predetermined spaced relationship relative to the port member for maintaining predetermined compression of said valve members and thereby maintaining sealing pressure between said valve members and said port member, said slot elements including respective guide walls disposed in parallel opposition to said port member and slidably engaged by the corresponding tongue elements, the carriage of each push button having its own tongue element projecting rearwardly therefrom in the predetermined direction of depressing movement thereof, the slot elements and the guide walls being provided on said port member as flange structure thereon, said push buttons having respective front and rear portions, the corresponding carriages being provided on the rear portions of the respective push buttons, said first mentioned guiding means including means for slidably confining the front portions of the respective push buttons against movement away from said port member to assist in maintaining compression of said valve members and thereby maintaining sealing pressure between said valve members and said port member.

2. A control device according to claim 1, in which said tongue elements have respective rounded projections for slidably riding along the corresponding guide walls and thereby facilitating the sliding movement of the corresponding tongue elements.

3. A control device according to claim 1, the carriages of at least some of said push buttons having respective individual leaf spring contactors mounted thereon and facing therefrom in a direction opposite from the facing direction of the valve members, said housing of said control device having fixed contact means for selective engagement by said contactors, said spring contactors being compressed against said fixed contact means for producing spring pressure therebetween.

4. A vacuum-electric control device for automotive air control systems, said device comprising a stationary housing, a push button array including a plurality of push buttons for accomplishing various electrical switching and vacuum valving functions, guiding means in said housing for guiding each of said push buttons for sliding movement in a predetermined direction between forwardly extended and rearwardly depressed positions, said push buttons including respective carriages fixed thereon for sliding movement therewith, each of said carriages having first and second opposite sides, each of said carriages having a soft resilient individual valve member mounted on said first side thereof, a stationary port member in said housing and slidably engageable by each valve member, said port member having port means traversed by at least some of the valve members for accomplishing at least one vacuum valving function in response to the movement of the push buttons between the extended and depressed positions thereof, at least some of said carriages having respective electrical contactors thereon for movement therewith, each contactor being positioned on the second side of the corresponding carriage, fixed contact means in said housing for selective sliding engagement by at least certain of said contactors, and a plurality of individual coil springs compressed between stationary means in said housing and the respective carriages of the respective push buttons for biasing the push buttons outwardly toward their extended positions, each carriage having a spring nest member thereon formed with a spring nest for receiving and locating a forwardly disposed portion of the corresponding coil spring, each spring nest member and the corresponding spring nest being offset laterally on the corresponding carriage relative to the positions of the corresponding valve member and contactor and being disposed alongside the positions of the corresponding valve member and contactor whereby the forwardly disposed portion of the corresponding coil spring is in an overlapping relation to the positions of the valve member and the contactor to accommodate a spring of exceptional length while affording a compact construction.

5. A vacuum-electric control device for automotive air control systems said device comprising a stationary housing, push button array including a plurality of push buttons for accomplishing various electrical switching and vacuum valving functions, guiding means in said housing for guiding each of said push buttons for sliding movement in a predetermined direction between forwardly extended and rearwardly depressed positions, said push buttons including respective carriages fixed thereon for sliding movement therewith, each of said carriages having first and second opposite sides, each of said carriages having a soft resilient individual valve member mounted on said first side thereof, a stationary port member in said housing and slidably engageable by each valve member, said port member having port means traversed by at least some of the valve members for accomplishing at least one vacuum valving function in response to the movement of the push buttons between the extended and depressed positions thereof, at least some of said carriages having respective electrical contactors thereon for movement therewith, each contactor being positioned on the second side of the corresponding carriage, fixed contact means in said housing for selective sliding engagement by at least certain of said contactors, and a plurality of individual coil springs compressed between stationary means in said housing and the respective carriages of the respective push buttons for biasing the push buttons outwardly toward their extended positions, each carriage having a spring nest member thereon formed with a spring nest for receiving and locating a forwardly disposed portion of the corresponding coil spring, each spring nest member and the corresponding spring nest being offset laterally on the corresponding carriage relative to the positions of the corresponding valve member and the contactor and being disposed alongside the positions of the corresponding valve member and contactor whereby the forwardly disposed portion of the corresponding coil spring is in an overlapping relation to the positions of the valve member and the contactor to accommodate a spring of exceptional length while affording a compact construction, each spring nest being generally semicylindrical in form and having an open side facing toward and in proximity to said port member, each coil spring being received in the corresponding semicylindrical spring nest and being loosely confined between the corresponding spring nest member and the port member.

6. A control device according to claim 5, in which said stationary means comprise flange structure formed on said port member and disposed rearwardly from the corresponding spring nest members on said carriages, the corresponding coil springs being compressed between said flange structure and the corresponding spring nest members.

7. A control device according to claim 5, in which each carriage has a detent tab projecting rearwardly therefrom into the corresponding spring nest, said detent tab having detent means thereon for detaining the forwardly disposed portion of the corresponding coil spring whereby the assembly of the control device is facilitated.

8. A vacuum-electric control device for automotive air control systems, said device comprising a stationary housing, a push button array including a plurality of push buttons arranged in a group and projecting from said housing, guide means in said housing for guiding each of said push buttons for sliding movement between forwardly extended and rearwardly depressed positions, a plurality of springs disposed between the housing and the respective push buttons for biasing the respective push buttons toward their forwardly extended positions, means in said housing for accomplishing a plurality of electrical switching and vacuum valving functions in response to depression of the various push buttons, a first latching mechanism including movable latching means in said housing and individual latching means on said push buttons for individually latching any selected one of the push buttons in its depressed position while unlatching any previously latched push button, an additional push button projecting from said housing in addition to said group, additional guide means in said housing for guiding said additional push button for sliding movement between forwardly extended and rearwardly depressed positions, an additional spring disposed between the housing and the additional push button for biasing the additional push button toward its forwardly extended position, additional means in said housing for accomplishing an additional control function in response to substantial depression of said additional push button, a push-push latching mechanism including means in said housing and means on said additional push button for latching the additional push button in its substantially depressed position when the additional push button is first depressed and for unlatching the additional push button when the additional push button is depressed again, a delatching mechanism including means operable by depression of a particular push button of said group for actuating said delatching mechanism, and means operable by said delatching mechanism for disabling said push-push latching mechanism and thereby unlatching said additional push button if previously latched.

9. A control device according to claim 8, in which said push-push latching mechanism including a movable latching element mounted on said additional push button and a second latching element mounted on said housing for latching engagement with said movable latching element, said delatching mechanism including a first component movable by depression of said particular push button, and a second component movable by said first component for effecting relative movement between said movable latching element and said second latching element for disabling said push-push latching mechanism and unlatching said movable latching element and said second latching element if previously latched.

10. A control device according to claim 9, in which said movable latching element comprises a latching hook swingably mounted on said additional push button and having a biasing spring connected between said hook and said additional push button, said latching hook being movable into latching engagement with said second latching element, said second component being movable against said latching hook for displacing it out of latching relation with said second latching element against the action of said biasing spring.

11. A control device according to claim 10, in which said second component comprises a translatable pin, said housing having means for slidably mounting said pin for displacing movement against said latching hook, said first component including motion translating means operable by depression of said particular push button for moving said pin against said hook and thereby displacing said hook out of latching relation with said second latching element.

12. A control device according to claim 11, in which said first component comprises a translatable delatching bar, said housing having means for slidably supporting said delatching bar, said delatching bar having a cam thereon for engaging and actuating said pin, said particular push button having a cam element thereon for actuating said delatching bar, and a cam follower element on said delatching bar for translating the depression of said particular push button into delatching movement of said delatching bar.

13. A vacuum-electric control device for automotive air control systems, said device comprising a stationary housing, a push button array including a plurality of push buttons projecting from said housing, guide means in said housing for guiding each of said push buttons for sliding movement between forwardly extended and rearwardly depressed positions, a plurality of springs disposed between the housing and the respective push buttons for biasing the respective push buttons toward their forwardly extended positions, means in said housing for accomplishing a plurality of electrical switching and vacuum valving functions in response to depression of the various push buttons, said push buttons being arranged in first and second distinct groups of said push buttons, each of said groups comprising a separate plurality of said push buttons, first and second separate and distinct latching mechanisms for cooperating with the respective first and second groups of said push buttons, said first latching mechanism including first movable latching means in said housing and first individual latching means on said push buttons of said first group for individually latching any selected one of the push buttons of said first group in its depressed position while unlatching any previously latched push button of said first group, said second latching mechanism including second movable latching means in said housing and second individual latching means on said push buttons of said second group for individually latching any selected one of the push buttons of said second group in its depressed position while unlatching any previously latched push button of said second group, and a delatching mechanism separate from said first and second latching mechanisms and including actuating means operable by depression of a particular push button of said first group of push buttons for actuating said delatching mechanism, and operative means operable by said delatching mechanism for disabling said second latching mechanism and thereby unlatching any previously latched push button of said second group of push buttons.

14. A control device according to claim 13, said first movable latching means comprising a first latching bar movable in said housing between latching and unlatching positions and a first spring for biasing said first latching bar toward its latching position, said first individual latching means on said push buttons of said first group being engageable with said first latching bar for individually latching any selected one of the push buttons of said first group in its depressed position while unlatching any previously latched push button of said first group, said second movable latching means including a second latching bar movable in said housing between latching and unlatching positions and a second spring for biasing said second latching bar toward its latching position, said second individual latching means on said push buttons of said second group being engageable with said second latching bar for individually latching any selected one of the push buttons of said second group in its depressed position while unlatching any previously latched push button of said second group, said delatching mechanism comprising a delatching bar movable in said housing and having an actuating member corresponding with said actuating means and operable by depression of said particular push button for moving said delatching bar in a delatching direction, said delatching bar having an operative member corresponding with said operative means for engaging said second latching bar and moving said second latching bar to its unlatching position in response to movement of said delatching bar in said delatching direction.

15. A control device according to claim 14, said particular push button having a delatching cam element thereon for engaging said actuating member and causing movement of said delatching bar in said delatching direction in response to depression of said particular push button.

* * * * *